US008226078B2

(12) United States Patent
Watanabe et al.

(10) Patent No.: US 8,226,078 B2
(45) Date of Patent: Jul. 24, 2012

(54) SHEET PROCESSING APPARATUS AND IMAGE FORMING SYSTEM

(75) Inventors: Kiyoshi Watanabe, Matsudo (JP); Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 129 days.

(21) Appl. No.: 12/890,054

(22) Filed: Sep. 24, 2010

(65) Prior Publication Data

US 2011/0081186 A1 Apr. 7, 2011

(30) Foreign Application Priority Data

Oct. 7, 2009 (JP) ..... 2009-232999

(51) Int. Cl.
*B31F 1/10* (2006.01)

(52) U.S. Cl. ..... 270/45; 270/32; 270/51; 270/58.07

(58) Field of Classification Search ..... 270/32, 270/45, 51, 58.07; 412/22; 493/406, 407, 493/442, 454
See application file for complete search history.

(56) References Cited

U.S. PATENT DOCUMENTS

| | | | | |
|---|---|---|---|---|
| 5,443,248 | A | 8/1995 | Hayashi et al. | |
| 5,735,515 | A | 4/1998 | Hayashi et al. | |
| 5,951,000 | A | 9/1999 | Sato et al. | |
| 6,692,208 | B1 | 2/2004 | Watkiss et al. | |
| 7,147,598 | B2 * | 12/2006 | Fujimoto et al. | 493/405 |
| 7,594,645 | B2 * | 9/2009 | Suzuki et al. | 270/37 |
| 7,681,872 | B2 | 3/2010 | Hayashi | |
| 2005/0189688 | A1 * | 9/2005 | Suzuki et al. | 270/32 |
| 2008/0101836 | A1 | 5/2008 | Fujita et al. | |
| 2010/0230886 | A1 * | 9/2010 | Watanabe et al. | 270/45 |

FOREIGN PATENT DOCUMENTS

JP 2005-298130 10/2005

* cited by examiner

*Primary Examiner* — Leslie A Nicholson, III

(74) *Attorney, Agent, or Firm* — Fitzpatrick, Cella, Harper & Scinto

(57) ABSTRACT

A sheet processing apparatus includes a holding portion that holds a booklet, which includes folded sheets, by a pair of holding members, a pressing portion having a first pressing member, which is brought into contact with a spine of a booklet held by the holding portion so as to perform a deforming process to the spine, and a second pressing member having a thickness, in the thickness direction of the booklet, greater than that of the first pressing member, a moving portion that moves the pressing member along the spine, and a controlling portion that changes the first pressing member to the second pressing member, and increases a deformation amount from the spine before the deformation to a pressing position in the pressing direction where the second pressing member presses the spine, when the thickness of the booklet held by the holding portion exceeds a predetermined thickness.

12 Claims, 19 Drawing Sheets

SHEET PROCESSING APPARATUS AND IMAGE FORMING SYSTEM

BACKGROUND OF THE INVENTION

1. Field of the Invention

The present invention relates to a sheet processing apparatus and an image forming system that processes a spine of a booklet made of folded sheets.

2. Description of the Related Art

When about 20 or more sheets are folded at a time, a booklet may be formed having a vicinity of a spine being curved. The folded state of the booklet described above is insufficient, so that the booklet is soon opened even after it is folded. Therefore, the appearance is degraded. The booklet described above cannot lie flat, so that it is difficult to stack a great number of booklets. In order to solve the problem described above, U.S. Pat. No. 6,692,208 describes a sheet processing apparatus for squaring a spine of a booklet as one of deforming processes in which the spine of the booklet is pressed to be deformed into a rectangular shape.

The invention disclosed in U.S. Pat. No. 6,692,208 relates to a sheet processing apparatus having cramping jaws that hold and fix a booklet with a folded state, a stop plate that projects from the cramping jaws to be capable of regulating the length of the booklet, and a pressing roller that performs a press forming to a spine of the booklet. According to the sheet processing apparatus described above, the spine of the booklet is squared, so that the spine of the booklet can be deformed into a rectangular shape. From the viewpoint of view, the poor-looking appearance described above is corrected, and when a great number of booklets are stacked, the posture of the booklets is stabilized.

However, in the invention described in U.S. Pat. No. 6,692,208, the spine, which projects from the cramping jaws, of the booklet is pressed. Therefore, when the deformation amount is great, the squared spine might spread in the thickness direction of the booklet. This gives a less attractive appearance. When a predetermined pressing force is applied to a spine that projects in a predetermined amount, a deformed amount of the spine becomes excessive when the thickness of the booklet is small, while the deformation becomes insufficient due to the insufficient pressing force to the spine when the thickness of the booklet is great.

The present invention is accomplished in view of the above-mentioned problem, and aims to provide a sheet processing apparatus that can prevent an excessive deformation to a spine of a thin booklet and insufficient deformation to a spine of a thick booklet in order to stabilize the shape of the booklet that is subject to a deforming (squaring) process.

SUMMARY OF THE INVENTION

A sheet processing apparatus according to the present invention includes a holding portion that holds a booklet, which includes folded sheets, by a pair of holding members opposite to each other, a pressing portion configured to press a spine of the booklet held by the holding portion, having a first pressing member and a second pressing member having a thickness, in the thickness direction of the booklet, greater than that of the first pressing member, and a moving portion that moves the pressing member along the spine, wherein one of the first pressing member and the second pressing member selectively enters a gap between the pair of holding members and presses the spine of the booklet held by the holding portion while the pressing member is moving along the spine so as to deform the spine, and wherein in a case of processing a booklet having a thickness greater than a predetermined thickness, the second pressing member is selected to press the spine, and a pressing amount in the pressing direction of pressing the spine by the second pressing member is greater than that by the first pressing member.

Further features of the present invention will become apparent from the following description of exemplary embodiments with reference to the attached drawings.

DESCRIPTION OF THE EMBODIMENTS

In the following, exemplary embodiments of the present invention will be described in detail in an exemplified manner with reference to the drawings. Here, dimensions, materials, shapes, relative arrangements thereof and the like described in the following embodiment are to be appropriately modified according to a configuration of an apparatus to which the present invention is applied and various conditions. Therefore, unless otherwise specified, the scope of the present invention is not to be limited thereto.

First Embodiment

Figure 1:
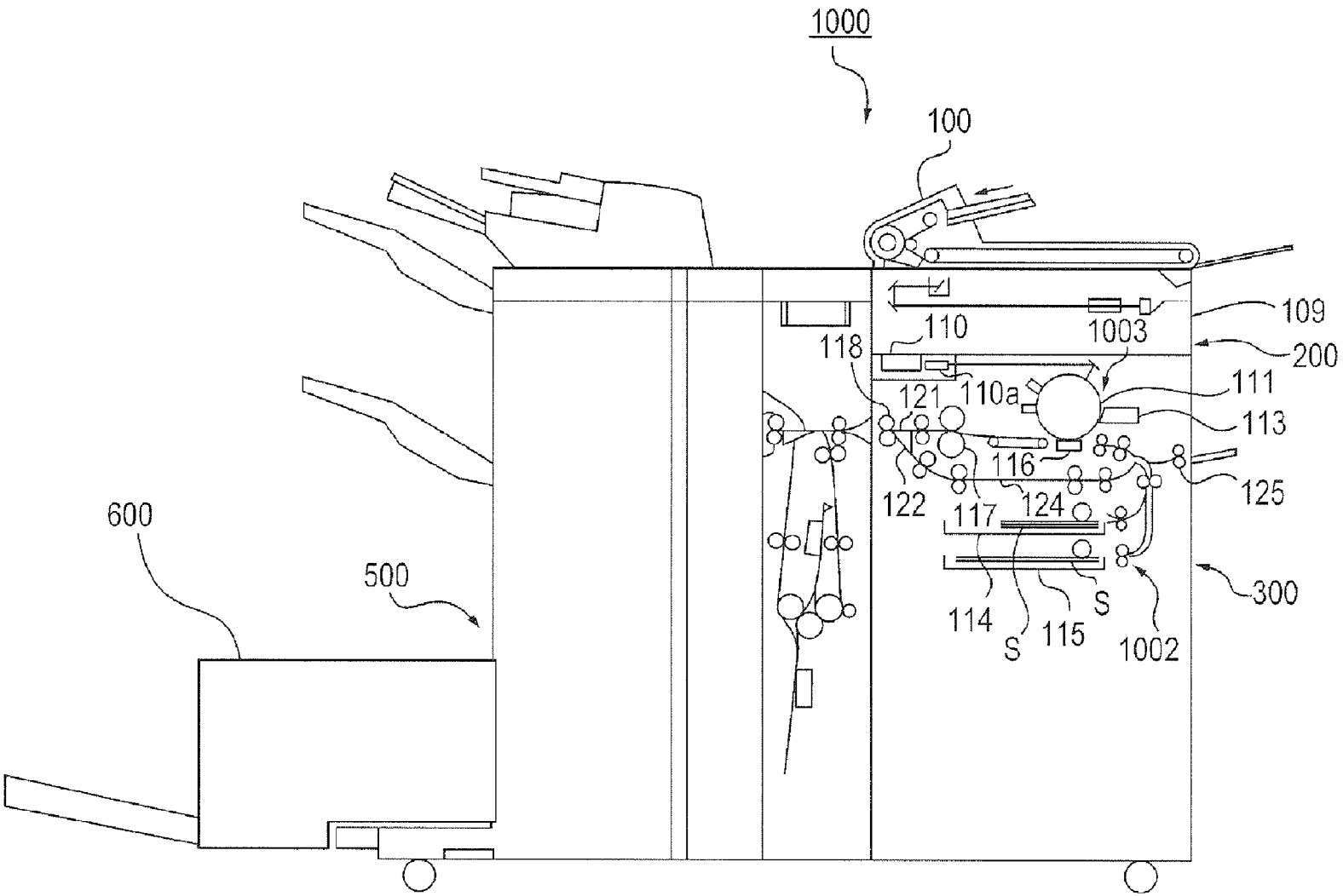
FIG. 1 is a sectional view illustrating a configuration of a copying machine to which a sheet processing apparatus according to a first embodiment of the present invention can be applied.

FIG. 1 is a sectional view illustrating a configuration of an image forming system including a sheet processing apparatus and a main part of an image forming apparatus according to an embodiment of the present invention. As illustrated in FIG. 1, a copying machine 1000, which is the image forming system according to the embodiment of the present invention, includes a printer portion 300, a finisher 500, a saddle stitch binding portion 800 (see FIG. 2), and a squaring processing apparatus 600. The image forming apparatus main body includes a document feed portion 100, an image reader portion 200, and a printer portion 300, wherein the printer portion 300 includes an image forming portion to form an image onto a sheet.

The printer portion 300 includes a photosensitive drum 111, an exposure controlling portion 110, a development device 113, and a transfer device 116. The exposure controlling portion 110 receives data obtained by performing a predetermined image process to image data of a document sheet read by an image sensor 109. The exposure controlling portion 110 outputs a laser beam according to an image signal. The laser beam is irradiated on a surface of the photosensitive drum 111 as being scanned by a polygon mirror 110*a*. An electrostatic latent image is formed on the surface of the photosensitive drum 111 according to the scanned laser light. An image forming portion 1003 includes the photosensitive drum 111, the exposure controlling portion 110, the development device 113, and the transfer device 116.

The electrostatic latent image formed on the surface of the photosensitive drum 111 is developed by the development device 113, and made visible as a toner image. On the other hand, a sheet is conveyed to the transfer device 116 from any one of cassettes 114 and 115, a manual feed portion 125, and a duplex conveying path 124, those of which constitute a feed portion 1002. The toner image, which is made visible, is transferred onto the sheet at the transfer device 116. The sheet after the transfer is subject to a fixing process at a fixing device 117.

The sheet is temporarily guided to a path 122 by a flapper 121 after passing through the fixing device 117. After the trailing end of the sheet completely passes through the flapper 121, the sheet is switched back to be guided to a discharge roller 118 by the flapper 121. The sheet is then discharged from the printer portion 300 by the discharge roller 118. Thus, the sheet is discharged from the printer portion 300 in a state that the surface having the toner image formed thereon faces downward (face-down). When the sheet is a paper, this discharge mode is called reverse discharge. When a duplex printing is performed, the sheet is switched back after the trailing end of the sheet completely passes through the flapper 121, and then, guided to a duplex conveying path 124 by the flapper 121.

Figure 2:
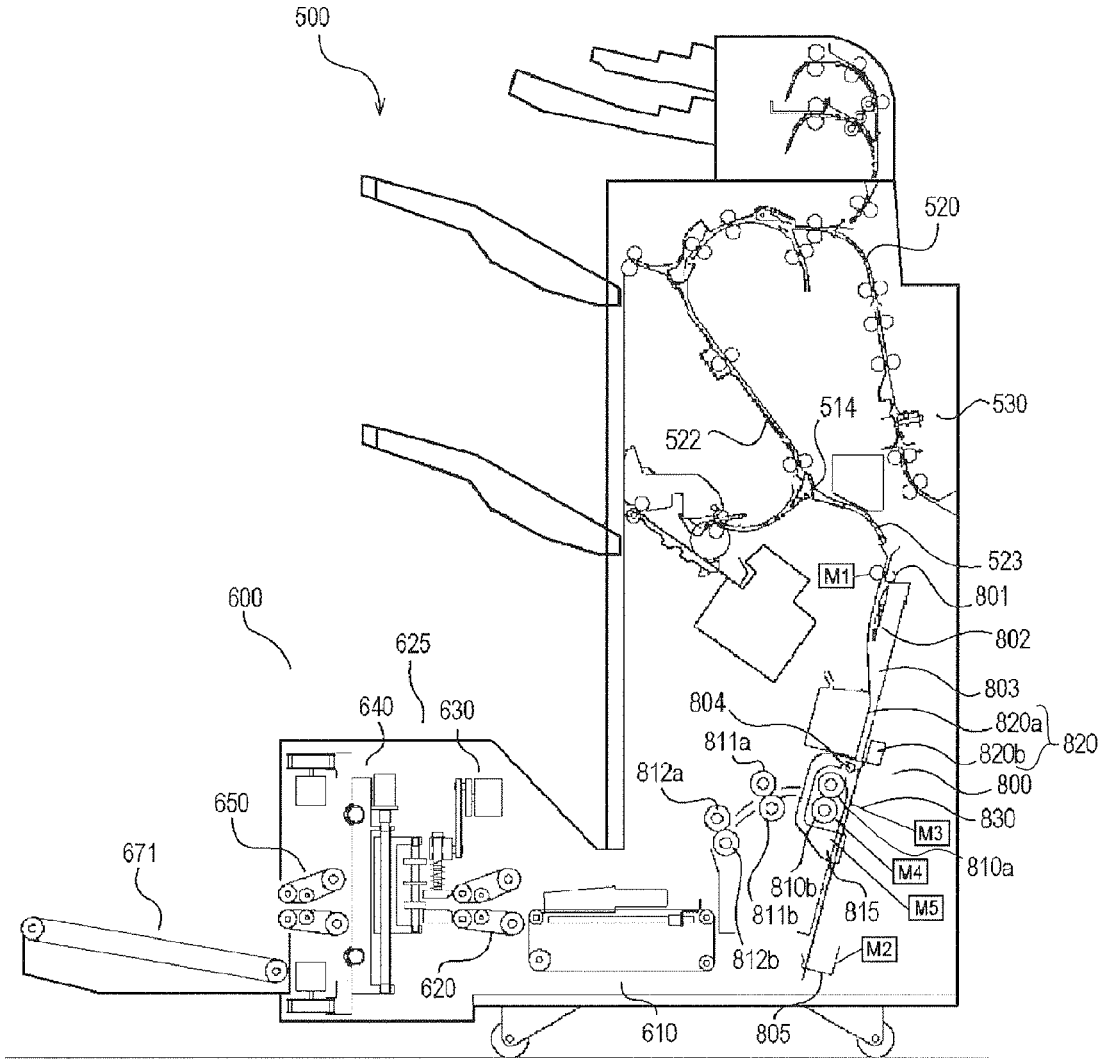
FIG. 2 is a sectional view illustrating a configuration of the sheet processing apparatus and a squaring processing apparatus.

FIG. 2 is a sectional view illustrating configurations of the finisher 500 and the squaring processing apparatus 600. The finisher 500 illustrated in FIG. 2 is an apparatus that performs a process in which plural sheets taken in the finisher are aligned and bound up as one bundle of sheets, a stapling process (binding process) of stapling a trailing end of the sheet bundle, a sorting process, and a non-sorting process. The finisher 500 includes a conveying path 520 that takes the conveyed sheet therein. The conveying path 520 is provided with plural pairs of conveying rollers. A punch unit 530 serving as a punching processing portion is arranged at a midpoint of the conveying path 520. The punch unit 530 is driven according to need so as to perform a punching process to the trailing end of the conveyed sheet.

Next, a configuration of the saddle stitch binding portion 800 will be described. A changeover flapper 514 is provided on a lower conveying path 522. The sheet switched by the changeover flapper 514 passes through a saddle discharge path 523, and is fed to the saddle stitch binding portion 800. A sheet fed to the saddle stitch binding portion 800 is accepted by a pair of saddle inlet rollers 801, wherein a carry-in port is selected by a flapper 802, which is operated by a solenoid, according to a size, and then, the sheet is carried in an accommodating guide 803 in the saddle stitch binding portion 800. The sheet is conveyed until the leading end thereof is brought into contact with a movable sheet positioning member 805 by a slide roller 804. A motor M1 drives the pair of saddle inlet rollers 801 and the slide roller 804. A stapler 820 is provided at the middle of the accommodating guide 803 so as to be arranged across the accommodating guide 803. The stapler 820 is divided into a driver 820*a* that projects staples and an anvil 820*b* that bends the projected staples. The sheet positioning member 805 stops at the portion where the central portion of the sheet in the sheet conveying direction X is located at the binding position of the stapler 820, when the sheet is carried in. The sheet positioning member 805 is movable through the drive of a motor M2, and changes its position according to a sheet size.

A pair of folding rollers 810*a* and 810*b* is provided at the downstream side of the stapler 820. A projecting member 830, which constitutes a folding portion together with the pair of folding rollers 810*a* and 810*b*, is provided at the position opposite to the pair of folding rollers 810*a* and 810*b*. The position where the projecting member 830 retracts from the accommodating guide 803 is specified as a home position. When the projecting member 830 projects toward an accommodated sheet bundle by the drive of a motor M3, it folds the sheet bundle as pushing the same into a nip between the pair of folding rollers 810*a* and 810*b*. Thereafter, the projecting member 830 returns again to the home position. Pressure F1 sufficient for making a fold to the sheet bundle is applied between the pair of folding rollers 810*a* and 810*b* by a spring (not illustrated). The sheet bundle having the fold formed thereon is conveyed to the squaring processing apparatus 600 (see FIG. 1) through a pair of first fold conveying rollers 811*a* and 811*b* and a pair of second fold conveying rollers 812*a* and 812*b*. Pressures F2 and F3 sufficient for conveying and stopping the sheet bundle, on which the fold is formed, are applied respectively to the pair of first fold conveying rollers 811*a* and 811*b* and the pair of second fold conveying rollers 812*a* and 812*b*.

The pair of folding rollers 810*a* and 810*b*, the pair of first fold conveying rollers 811*a* and 811*b*, and the pair of second fold conveying rollers 812*a* and 812*b* are rotated at the constant speed by the same motor M4 (not illustrated). When the sheet bundle bound by the stapler 820 is folded, the sheet positioning member 805 is lowered from the location where the stapling process is performed by a predetermined distance in order that the stapling position of the sheets is located at the nip position between the pair of folding rollers 810*a* and 810*b* after the stapling process is completed. With this process, the sheet bundle can be folded with the position where the stapling process is performed being defined as a center. A pair of aligning plates 815 surrounds the outer periphery of the pair of folding rollers 810*a* and 810*b* and has a surface projecting to the accommodating guide 803 for aligning the sheet accommodated in the accommodating guide 803. The pair of aligning plates 815 receives the drive of a motor M5 to move in the nipping direction of the sheet, whereby the sheet is positioned in the width direction of the sheet.

Figure 3:
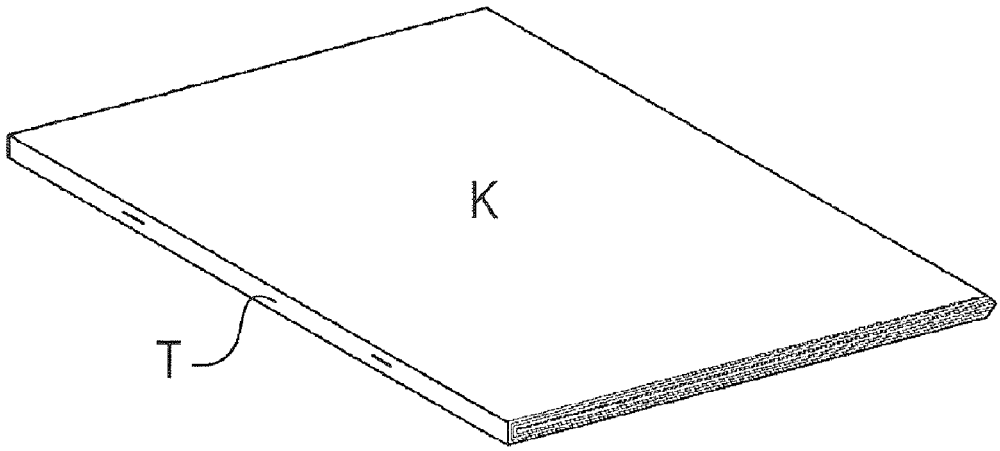
FIG. 3 is a perspective view illustrating a booklet after a squaring process.

FIG. 3 is a perspective view illustrating a booklet K that is subject to a squaring process by the squaring processing apparatus 600.

Figure 4:
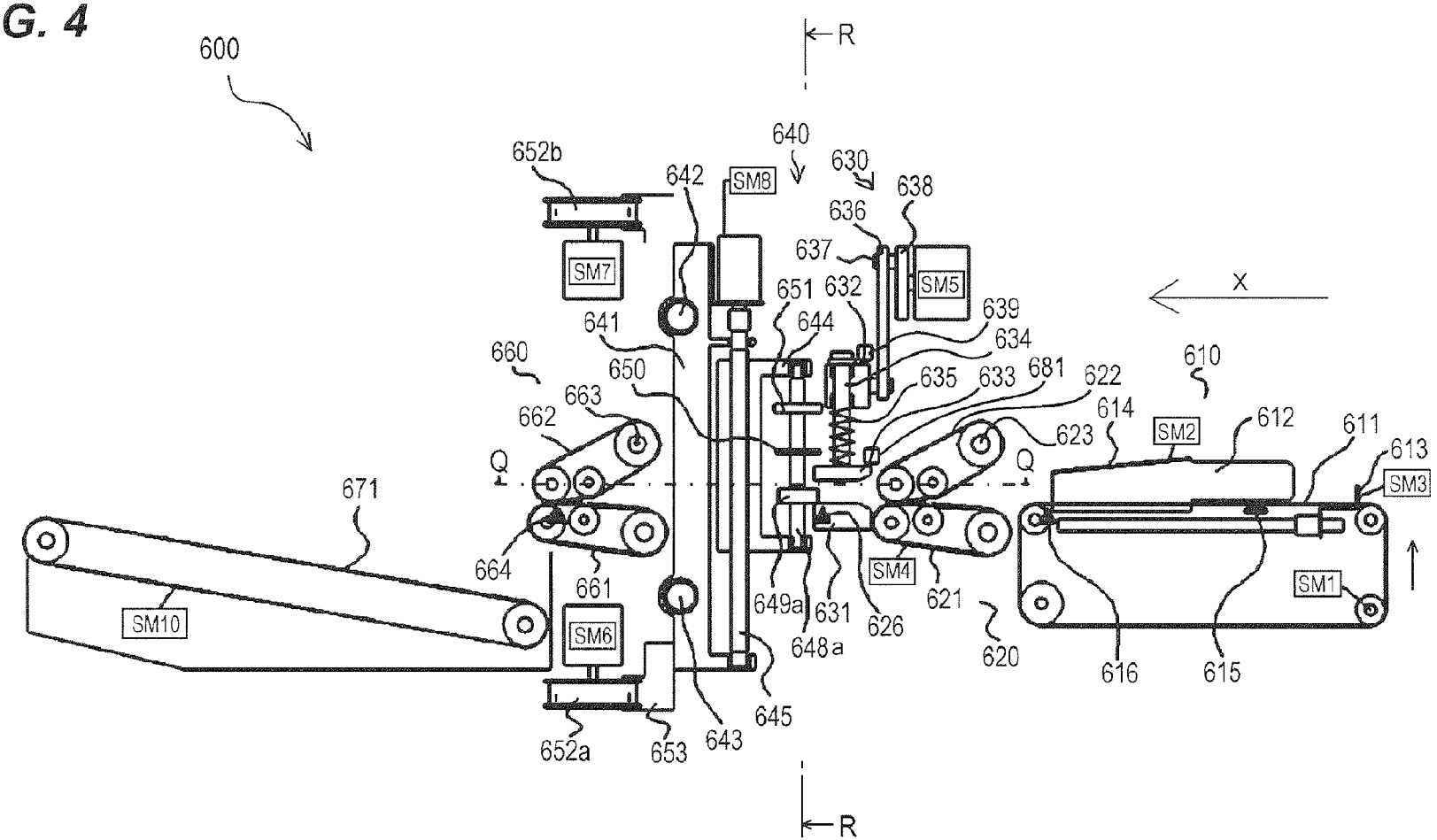
FIG. 4 is an enlarged sectional view illustrating the configuration of the squaring processing apparatus.

FIG. 4 is an enlarged sectional view illustrating the configuration of the squaring processing apparatus 600. The squaring processing apparatus 600 is located at the downstream side of the saddle stitch binding portion 800 (see FIG. 2) in the sheet conveying direction X. As illustrated in FIG. 4, the squaring processing apparatus 600 includes a booklet receiving portion 610. The booklet receiving portion 610 includes a lower conveying belt 611 that extends in the sheet conveying direction X for receiving and conveying the booklet S from the saddle stitch binding portion 800. When the booklet S is received, the lower conveying belt 611 rotates in the direction indicated by an arrow. Therefore, when the booklet S drops from the pair of second fold conveying rollers 812*a* and 812*b*, the booklet S is received with the posture kept as it is conveyed without rotating.

A pair of side guides 612 is arranged at the outside of the lower conveying belt 611 across the lower conveying belt 611. The pair of side guides 612 operates in the sheet width direction Y that is orthogonal to the sheet conveying direction X, thereby being capable of correcting the position of the booklet S in the sheet width direction Y. A pressing guide 614 for preventing the booklet S from being opened is formed at the upper part of the pair of side guides 612. The pressing guide 614 functions as a guide for smoothly feeding the booklet S to the downstream side in the sheet conveying direction X. A transport claw 613 that moves parallel to the lower conveying belt 611 is arranged at both sides of the lower conveying belt 611. The transport claw 613 moves in the forward and reverse directions with the speed substantially equal to the speed of the lower conveying belt 611. When a slippage is produced between the lower conveying belt 611 and the booklet S, the transport claw 613 is brought into contact with the trailing end of the booklet S to surely push the trailing end of the booklet toward the downstream side in the sheet conveying direction X. The lower conveying belt 611, the pair of side guides 612, and the transport claw 613 respectively operate through drives of the motors SM1, SM2, and SM3. An inlet detection sensor 615 detects that the booklet S received from the saddle stitch binding portion 800 is on the lower conveying belt 611. An outlet detection sensor 616 detects the booklet S, thereby outputting an input signal for operating the pair of side guides 612 and the transport claw 613.

The conveying portion 620 includes a lower conveying belt 621 and an upper conveying belt 622 for receiving the booklet S from the booklet receiving portion 610 and for conveying the same toward the downstream side in the sheet conveying direction X. The upper conveying belt 622 can pivot about a supporting point 623 according to a thickness of the booklet S. The upper conveying belt 622 is pressed against the lower conveying belt 621 by a spring (not illustrated). The upper and lower conveying belts 621 and 622 are driven by a drive motor SM4.

The squaring processing apparatus 600 includes a holding unit 630, serving as a holding portion, that nips and holds the vicinity of the spine T of the booklet S in the vertical direction, and a squaring unit 640, serving as a pressing portion, that positions the spine T of the booklet S and presses the spine T of the booklet S.

The holding unit 630 serving as a holding portion includes a lower holding plate 631 serving as a first holding member and an upper holding plate 633 serving as a second holding member. The lower holding plate 631 has a lower holding surface 631*a* (see FIG. 7) that serves as a first holding surface for holding the booklet S from below, while the upper holding plate 633 has an upper holding surface 633*a* (see FIG. 7) that serves as a second holding surface for holding the booklet S from above. The holding unit 630 holds the booklet S, which includes folded sheets, between the opposing lower holding surface 631*a* and the upper holding surface 633*a*. The lower holding plate 631 is fixed, but the upper holding plate 633 is configured to be capable of lifting and lowering.

The upper portion of the holding unit 630 includes a strong holding base 632 that receives drive of a drive motor SM5 to move in the vertical direction through links 636, 637, and 638, the upper holding plate 633 that is coupled by a slide coupling member 634, and a compression spring 635 that is arranged at the outer periphery of the slide coupling member 634. When the holding base 632 is at the upper position, the lower holding plate 631 and the upper holding plate 633 are separated from each other, wherein the booklet S is conveyed between the lower and upper holding plates 631 and 633. When the holding base 632 is at the lower position, the booklet S is firmly nipped and held by the lower holding plate 631 and the upper holding plate 633 by the compression spring 635 that is expanded and compressed according to the thickness of the booklet S. The lower holding surface 631*a* of the lower holding plate 631 and the upper holding surface 633*a* of the upper holding plate 633 that hold the booklet S are smooth surfaces having no projection. Therefore, a pressing mark cannot be formed on the booklet S when the booklet S is nipped and held. A top dead center detection sensor 639 detects that the holding base 632 is at the upper position. A thickness detection sensor 681 detects the position of the upper holding plate 633 when the booklet S is fixed, thereby calculating the thickness of the booklet S.

The squaring unit 640 includes a first pressing member 650 and a second pressing member 651, which serve as first and second pressing members, a changeover base 644 serving as a changeover portion, and a slide screw 645. The squaring unit 640 also includes timing belts 652*a* and 652*b*, which serve as a moving portion, and a stopper member 649 (see 649*a* and 649*b* in FIG. 5) serving as a positioning portion. One of the first pressing member 650 and the second pressing member 651 selectively presses the spine T at the pressing positions 650*p* and 651*p* (see FIG. 7) to perform a deforming process. They are mounted so as to be coaxial with support shafts 648*a* and 648*b*. One of the first pressing member 650 and the second pressing member 651 selectively enters a gap between the pair of holding members, i.e., between the lower holding plate 631 and the upper holding plate 633, to press the spine T of the booklet S that is held by the opposing lower holding surface 631*a* and the upper holding surface 633*a* (see FIG. 7). Upon the pressing, the second pressing member 651 and the first pressing member 650 are rotating members that rotate with the rotation of the support shaft 648*a*. Plural, i.e., two pressing members that are the second pressing member 651 and the first pressing member 650, are configured to have a different thickness (height) and different outer diameter in the thickness direction of the booklet. Therefore, the thickness of the first pressing member 650 and the thickness of the second pressing member 651 are different from each other, so that the deformation amount from the spine T of the booklet S, before the deformation, to the first pressing position 650*p* of the first pressing member 650 in the pressing direction and the deformation amount from the spine T to the second pressing position 651*p* of the second pressing member 651 in the pressing direction are different from each other. Although described in detail below, in other words, the thickness and diameter of the second pressing member 651 are greater than the thickness and diameter of the first pressing member 650. As a result, the deformation amounts of the first pressing member 650 and the second pressing member 651 in the pressing direction increase as the thickness of the booklet S increases. Accordingly, a controlling portion described below controls such that, when the thickness of the booklet S exceeds a predetermined thickness, the first pressing member 650 is changed to the second pressing member 651, and the deformation amount, in the pressing direction, from the spine T of the booklet S, before the deformation, to the pressing position 651*p* where the second pressing member 651 presses the spine T increases. The thicknesses and diameters of the stopper members 649*a* and 649*b* are also different from those of the first pressing member 650 and the second pressing member 651. In other words, the thicknesses and diameters of the first pressing member 650 and the second pressing member 651 are greater than the thicknesses and diameters of the stopper members 649*a* and 649*b*.

The changeover base 644 serving as the changeover portion and the slide screw 645 are configured to be capable of selectively changing the first pressing member 650 and the second pressing member 651, and the stopper members 649*a* and 649*b*. The timing belts 652*a* and 652*b*, which serve as the moving portion, move the selected first pressing member 650 and the second pressing member 651 along the spine T. The squaring unit 640 selects the one, which can enter a gap between the lower holding plate 631 and the upper holding plate 633 and has the greater thickness, of the first pressing member 650 and the second pressing member 651 based on the thickness of the booklet S, and moves the selected one along the spine T for pressing the spine T.

The stopper members 649*a* and 649*b* serving as the positioning portion position the spine T of the conveyed booklet S to a predetermined position (receiving position 649*p*) in the sheet conveying direction X. One of the first pressing member 650 and the second pressing member 651 presses the spine T of the booklet S, the spine T is positioned at the receiving position 649*p* by the stopper members 649*a* and 649*b*. Although described in detail below, the stopper members 649*a* and 649*b* serve as receiving members that receive the spine T of the conveyed booklet S at the receiving position 649*p*.

Figure 5:
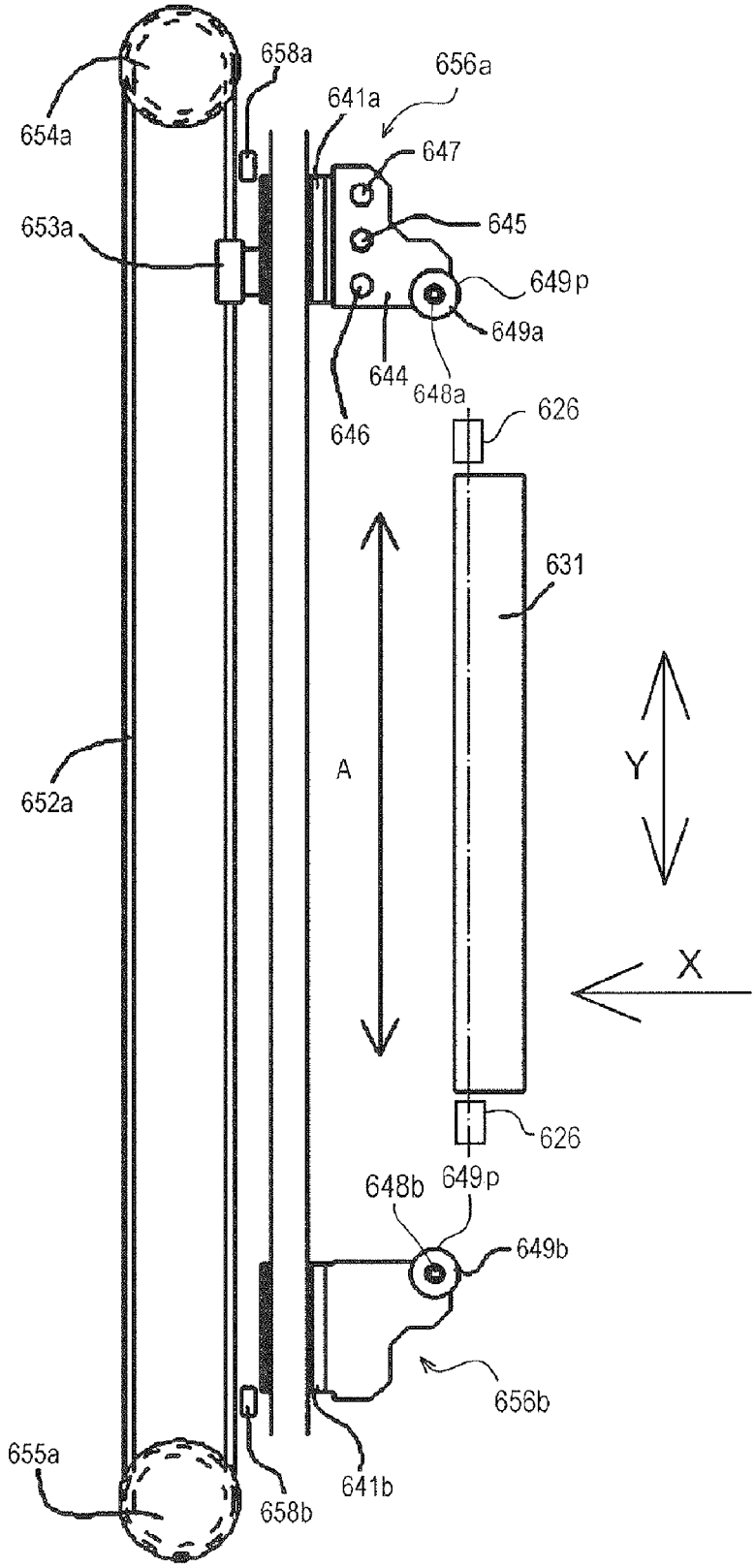
FIG. 5 is a schematic view illustrating the configuration of a main part of the squaring unit taken along a line Q-Q in FIG. 4.

FIG. 5 is a schematic view illustrating the configuration of a main part of the squaring unit 640 taken along a line Q-Q in FIG. 4. As illustrated in FIG. 5, the squaring unit 640 includes two moving units, which are a moving unit 656*a* and a moving unit 656*b*. These moving units 656*a* and 656*b* are movable along slide shafts 642 and 643 illustrated in FIG. 4 that are supported by a frame (not illustrated). The moving units 656*a* and 656*b* are supported so as to be movable in the direction of an arrow A as illustrated in FIG. 5. The moving units 656*a* and 656*b* are mounted to a timing belt 652*a* by a coupling member 653*a* in order to move in the direction of the arrow A. The timing belt 652*a* is driven by a drive motor SM6 through pulleys 654*a* and 655*a*.

Figure 6:
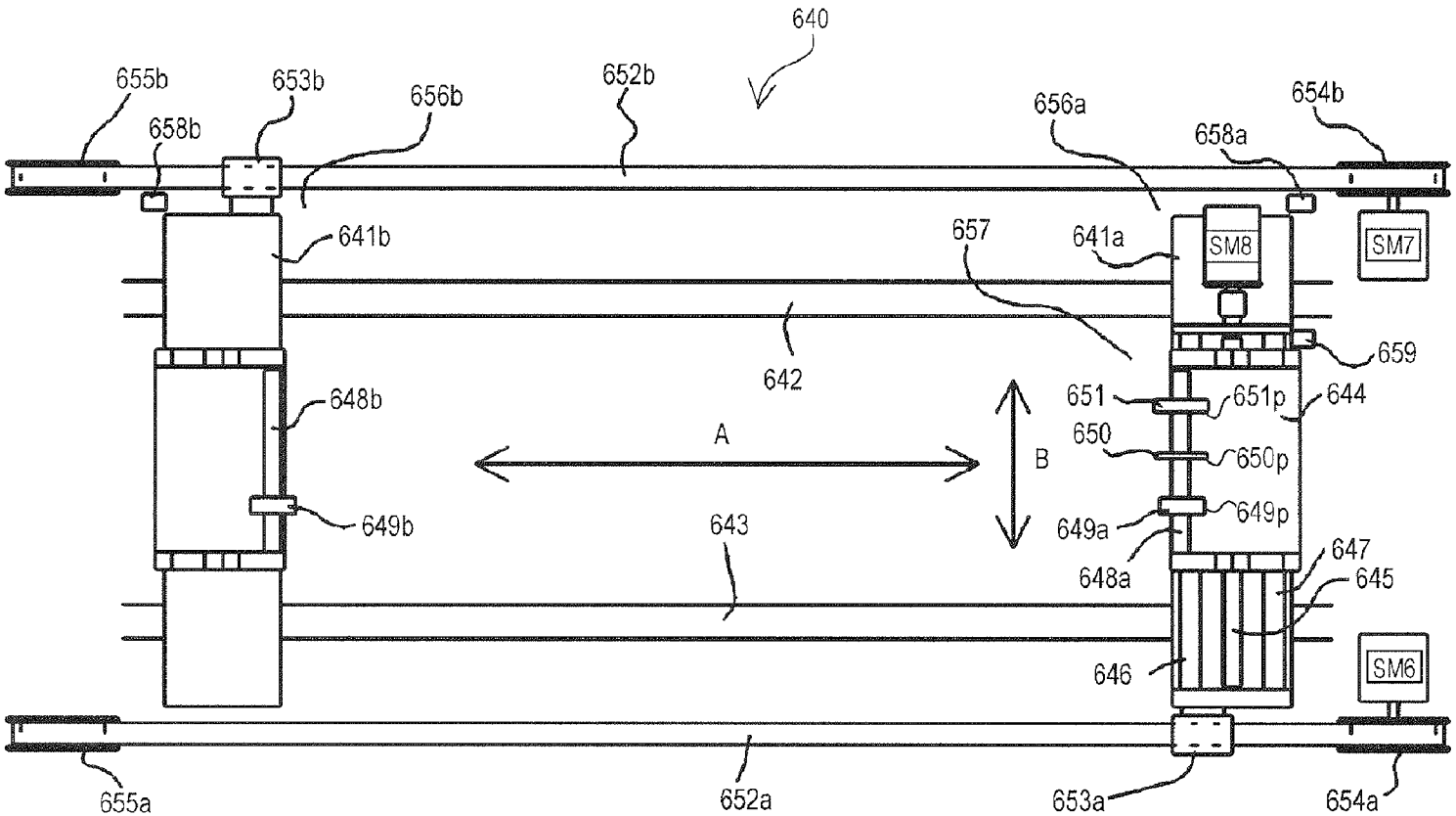
FIG. 6 is a schematic view illustrating the configuration of the main part of the squaring unit taken along a line R-R in FIG. 4.

FIG. 6 is a schematic view illustrating the configuration of the main part of the squaring unit 640 taken along a line R-R in FIG. 4. As illustrated in FIG. 6, the squaring unit 640 includes two moving units, which are the moving unit 656*a* and the moving unit 656*b*, as described above. As illustrated in FIG. 6, the squaring unit 640 includes slide shafts 642 and 643 extending in the horizontal direction as being supported by a frame (not illustrated). The moving units 656*a* and 656*b* are supported so as to be movable in the direction of the arrow A.

The moving unit 656*a* includes a moving base 641*a*, and the moving unit 656*b* includes a moving base 641*b*. The slide shafts 646 and 647 are fixed to the moving base 641*a* so as to extend in the vertical direction. The changeover unit 657 is slidably supported along the slide shafts 646 and 647. The changeover unit 657 are movable in the vertical direction indicated by an arrow B along the slide screw 645, which is arranged parallel to the slide shafts 646 and 647, by the slide screw 645 and a drive motor SM8 that rotates the slide screw 645.

The changeover unit 657 includes a changeover base 644. A support shaft 648*a* is mounted to the changeover base 644 so as to be rotatable. As described above, the stopper members 649*a* and 649*b*, which serve as the positioning portion, and the first pressing member 650 and the second pressing member 651, which serve as the pressing member, are fixed to the support shaft 648*a*.

The stopper member 649*a* is a member that positions, in cooperation with the above-mentioned stopper member 649*b*, the booklet S at a location where the deforming (squaring) process is performed to the booklet S, through the abutment of the spine T of the conveyed booklet S to the stopper member 649*a*. The first pressing member 650 and the second pressing member 651 are members that presses the spine T of the booklet S so as to perform the deforming (squaring) process. The first pressing member 650 and the second pressing member 651 are changed by the movement of the changeover unit 657 in the direction of the arrow B in FIG. 6 according to the thickness of the booklet S. The changeover unit 657 has a reference position detection sensor 659, which becomes a reference position when the changeover unit 657 moves in the direction of the arrow B.

The moving unit 656*b* is mounted to a timing belt 652*b* by a coupling member 653*b*, and driven by a drive motor SM7 through pulleys 654*b* and 655*b*. The moving unit 656*b* has the moving base 641*b*. The support shaft 648*b* is mounted to the moving base 641*b* so as to be rotatable. The stopper member 649*a* is fixed to the support shaft 648*b*. The stopper member 649*b* is a member that positions, in cooperation with the above-mentioned stopper member 649*a*, the booklet S at a location where the squaring process is performed to the booklet S, through the abutment of the spine T of the conveyed booklet S to the stopper member 649*b*. The moving units 656*a* and 656*b* are respectively provided with reference position detection sensors 658*a* and 658*b*, which become reference positions when the squaring unit 640 moves in the direction of the arrow A.

Since the configuration is as described above, the stopper members 649*a* and 649*b*, the first pressing member 650, and the second pressing member 651 can move in the sheet width direction Y that is parallel to the spine T of the booklet S, but cannot move in the sheet conveying direction X that is orthogonal to the spine T of the booklet S (see FIG. 7). The stopper member 649*a* can lift and lower, but the stopper member 649*b* is configured not to lift and lower.

FIG. 7 is a sectional view illustrating an abutment state in which the spine T of the booklet S abuts against the stopper members 649*a* and 649*b*, and the spine T of the booklet S is pressed by one of the first pressing member 650 and the second pressing member 651. The stopper members 649*a* and 649*b*, the first pressing member 650, and the second pressing member 651 illustrated in FIG. 7 are formed into a disk-like shape. The thicknesses and the diameters of the stopper members 649*a* and 649*b*, the first pressing member 650, and the second pressing member 651 will be described in detail below.

The lower holding plate 631 and the upper holding plate 633, serving as the holding members, respectively have the lower holding surface 631*a* and the upper holding surface 633*a* as described above. The lower holding surface 631*a* and the upper holding surface 633*a* hold the booklet S including the area of the spine T of the booklet S, as viewed from the direction (direction of the support shafts 648*a* and 648*b*) orthogonal to the lower holding surface 631*a* and the upper holding surface 633*a*. This will be described below in detail.

Figure 7E:
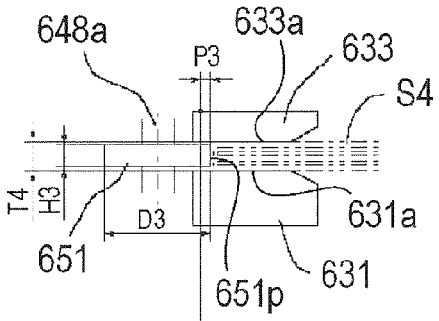
FIGS. 7A to 7F are sectional views illustrating an abutment state in which a spine abuts against a stopper member, a first pressing member, and a second pressing member.
Figure 7F:
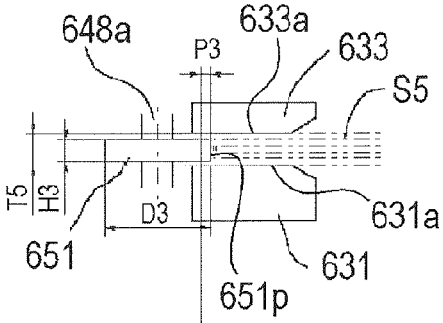
Figure 7C:
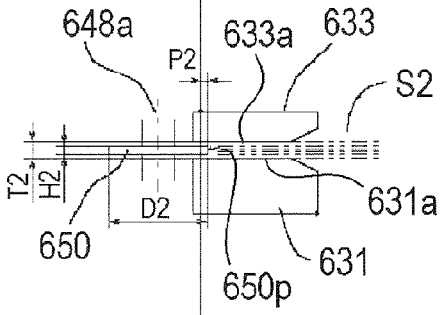
Figure 7D:
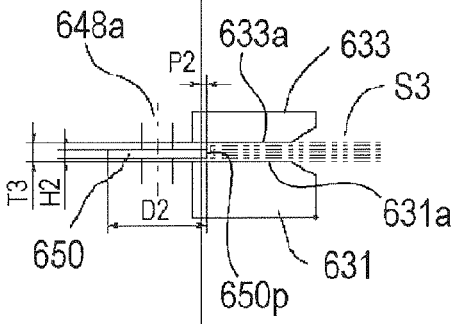
Figure 7A:
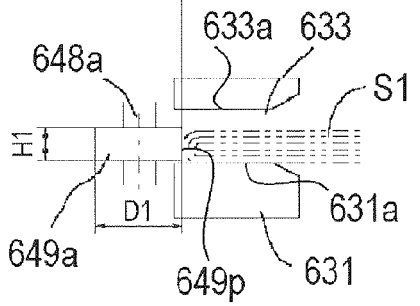
Figure 7B:
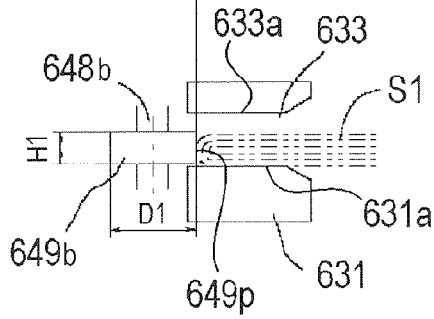

As illustrated in FIGS. 7A and 7B, the diameter of each of the stopper members 649*a* and 649*b* is D1. The booklet S enters between the lower holding plate 631 and the upper holding plate 633. The booklet S is positioned at the location between the lower holding plate 631 and the upper holding plate 633 where the booklet S does not protrude from the downstream side of the lower holding plate 631 and the upper holding plate 633 in the sheet conveying direction X. The thickness of the stopper members 649*a* and 649*b* in the thickness direction of the booklet S is set to H1 beforehand, which is greater than the thickness of the conveyed booklet S. This is for preventing the spine T of the booklet S from going over the stopper members 649*a* and 649*b*, even when the booklet S is thick.

A booklet formed by folding a single sheet in two to a booklet formed by folding 25 sheets in two are supposed to be the booklet formed by the saddle stitch binding portion 800 in the present embodiment. Among the booklets, the booklets S formed by folding 1 to 10 sheets in two are not subject to the squaring process, while the booklets S formed by folding 11 to 25 sheets in two are subject to the squaring process.

This is because the booklets formed by folding 1 to 10 sheets in two have a small thickness, and the curved portion of the spine T is small, so that the sufficient fold that is difficult to secure the deformation amount (pressing amount) for performing the squaring process, which is the deforming process, is formed. Therefore, even if the squaring process is performed, the ease of opening the booklet is unchanged. The booklets formed by folding 11 to 25 sheets in two are subject to the squaring process. When a booklet is formed by folding 11 to 25 sheets in two, the thickness is great, and the width of the booklet varies, so that the thickness of the booklet is classified into two stages. As illustrated in FIGS. 7C, 7D, 7E, and 7F, when the thickness of the booklet S is within T2 to T3, the pressing member is changed to the first pressing member 650 having the thickness of H2, while the pressing member is changed to the second pressing member 651 having the thickness of H3, when the thickness of the booklet S is within T4 to T5. Thus, the sheet process is performed.

The diameter D1 of each of the stopper members 649*a* and 649*b*, the diameter D2 of the first pressing member 650, and the diameter D3 of the second pressing member 651 have the relationship of D1<D2<D3. The deformation amount (pressing amount) P2 is represented by the equation of P2=(D2−D1)/2, when the first pressing member 650, which is used to perform the squaring process to a relatively thin booklet S, is employed. The P2 can be an entering amount of the first pressing member 650 to the spine T. The deformation amount (pressing amount) P3 is represented by the equation of P3=(D3−D1)/2, when the second pressing member 651, which is used to perform the squaring process to a relatively thick booklet S, is employed. The P3 can be an entering amount of the second pressing member 651 to the spine T. The inequality of (P2<P3) is set in order that the deformation amount (pressing amount) of the thick booklet S is greater than that of the thin booklet S.

In the present embodiment, the holding surfaces of the upper and lower holding plates 631 and 633 are not in contact with the spine of the booklet before the spine of the booklet is pressed. When the spine of the booklet is pressed by the pressing member, the spine of the booklet, which is not in contact with the holding surfaces of the upper and lower holding plates 631 and 633, starts to be deformed. However, the space between the holding surfaces, i.e., the deformation exceeding the thickness of the booklet held by the upper and lower holding plates 631 and 633, is regulated by the holding surfaces of the upper and lower holding plates 631 and 633. In this case, the holding surfaces of the upper and lower holding plates 631 and 633 serve as restricting surfaces for restricting the deformation of the spine in the thickness direction of the booklet. As described above, the deforming process is performed within the space between the holding surfaces, whereby deformation of the spine in the thickness direction is restricted, and hence, a stacking property is enhanced.

In the present embodiment, the pressing surfaces of the upper and lower holding plates 631 and 633 are set as smooth surfaces continuous with the holding surfaces of the upper and lower holding plates 631 and 633 that are parallel to each other. However, they do not have to be parallel to each other, so long as they can restrict the deformation exceeding the thickness of the booklet. The pressing surfaces do not need to be continuous with the holding surfaces of the upper and lower holding plates 631 and 633. They may be provided with the use of another member.

In the present embodiment, the deformation amount (pressing amount) to which the squaring process that is the deforming process is performed is set not by the positioned location by the stopper members 649*a* and 649*b* but by the diameters of the first pressing member 650 and the second pressing member 651. Since the thin booklet S and the thick booklet S are positioned by the same stopper members 649*a* and 649*b*, the booklet can be positioned at the same location, regardless of the thickness of the booklet. In the case of the thin booklet S, the pressing member used for the squaring process has a small thickness and small diameter, while in the case of the thick booklet S, the pressing member used for the squaring process has a great thickness and great diameter, in the present embodiment. This is based on the following. Specifically, the positioned location is set to be the same, regardless of the thickness of the booklet S, and the pressing amount of the thick booklet S is set to be always greater than that of the thin booklet S, whereby the excessive deformation of the thin booklet S and the insufficient deformation of the thick booklet S can be prevented. Therefore, the shape of the booklet S, which is subject to the squaring process, is stabilized.

In the present embodiment, the thickness of the booklet S is classified into two cases, and two types, which are the first pressing member 650 and the second pressing member 651, having a different thickness and different diameter, are used. However, the present invention is not limited thereto. Specifically, three, four, or more types of pressing members, each having a different thickness and different diameter, may be employed.

A rigidity (ease of deformation) of the booklet S may vary depending on a media to be used, even in the booklet S having the same thickness. In this case, the shape of the pressing member is not limited to a disk-like shape. Specifically, the shape of the pressing surface may be changed, for example, the center of the pressing surface of the pressing member that presses the spine is formed into a convex shape. Plural pressing members, each having a different pressing surface, may be prepared, and they may be changed according to the media that is used.

Figure 8A:
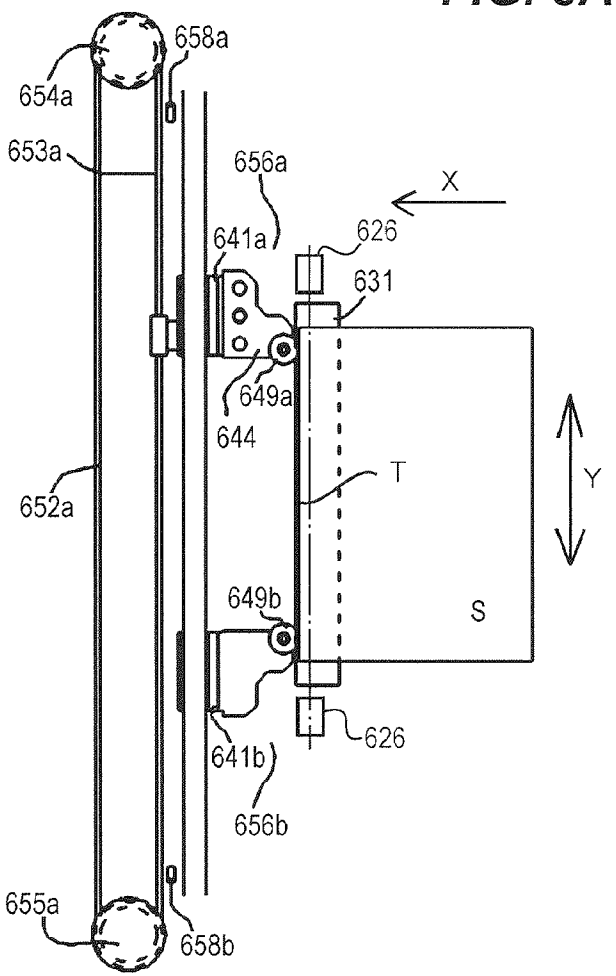
FIGS. 8A and 8B are process views illustrating an operation of the squaring unit.

FIGS. 8, 9, and 10 are process views illustrating the operation of the squaring unit 640. As described in FIG. 5, the stopper members 649*a* and 649*b*, the first pressing member 650, and the second pressing member 651 can move in the direction of the arrow A between the lower holding plate 631 and the upper holding plate 633 of the holding unit 630 through the slide movement of the moving units 656*a* and 656*b*. When the moving unit 656*a* is arranged at the position outside the portion between the lower holding plate 631 and the upper holding plate 633, the changeover unit 657 illustrated in FIG. 6 slides along the slide screw 645. As illustrated in FIG. 7, the first pressing member 650 and the second pressing member 651, which should be arranged between the lower holding plate 631 and the upper holding plate 633, are changed. The state in which the moving unit 656*a* is arranged at the position outside the portion between the lower holding plate 631 and the upper holding plate 633 means that the moving unit 656*a* is arranged at the side of the lower holding plate 631 and the upper holding plate 633 (see FIG. 8A).

When the booklet S is positioned by the holding unit 630, the stopper members 649*a* and 649*b* are located between the lower holding plate 631 and the upper holding plate 633 at the inside from the width of the booklet S as being symmetric about the center of the booklet S in the width direction, as illustrated in FIG. 8A. With this, the spine T of the booklet S is hit to the stopper members 649*a* and 649*b* to be positioned. The booklet S conveyed to the stopper members 649*a* and 649*b* is detected by the positioning detection sensor 626. The thickness of each of the stopper members 649*a* and 649*b* is set to be greater than the thickness of the booklet S in order that the spine T of the thick booklet S can be positioned through the abutment against the stopper members (see FIGS. 7A and 7B). When the stopper members 649*a* and 649*b* are located between the lower holding plate 631 and the upper holding plate 633, the upper holding plate 633 cannot hold the booklet S. From the above, the stopper members 649*a* and 649*b* have only the function of positioning the booklet S, and do not have the function of pressing the booklet S (see FIGS. 7A and 7B).

Figure 8B:
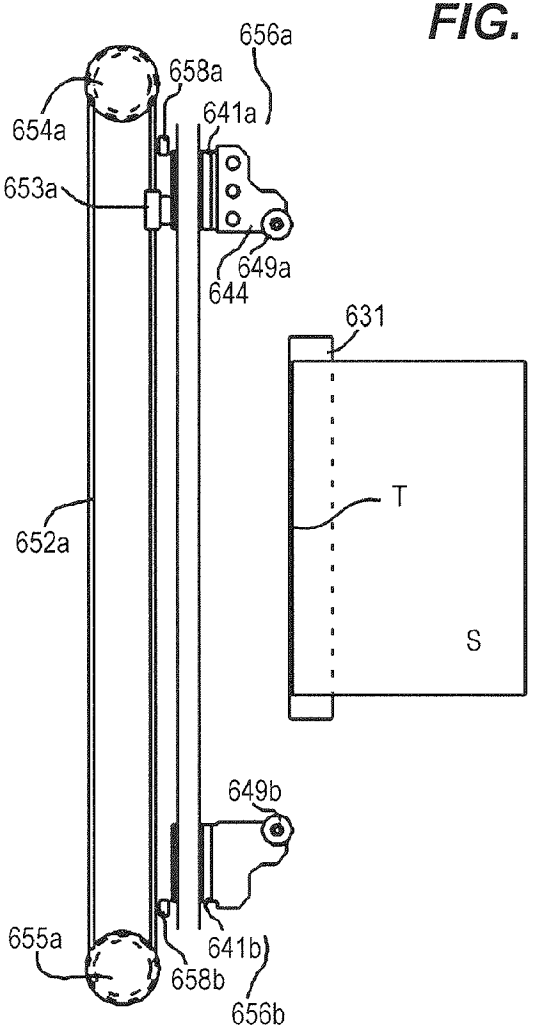

As illustrated in FIG. 8B, after the booklet S is positioned, the stopper members 649*a* and 649*b* are moved to the side of the lower holding plate 631 and the upper holding plate 633. Therefore, the spine T of the booklet S and its vicinity are pressed and held between the lower holding plate 631 and the upper holding plate 633 of the holding unit 630. In this case, the spine T of the booklet S does not protrude from the end face of the lower holding plate 631 and the upper holding plate 633 at the downstream side in the sheet conveying direction X. Since the booklet S is nipped and held by the lower conveying belt 621 and the upper conveying belt 622 of the conveying portion 620, the booklet S is prevented from being shifted.

Figure 9A:
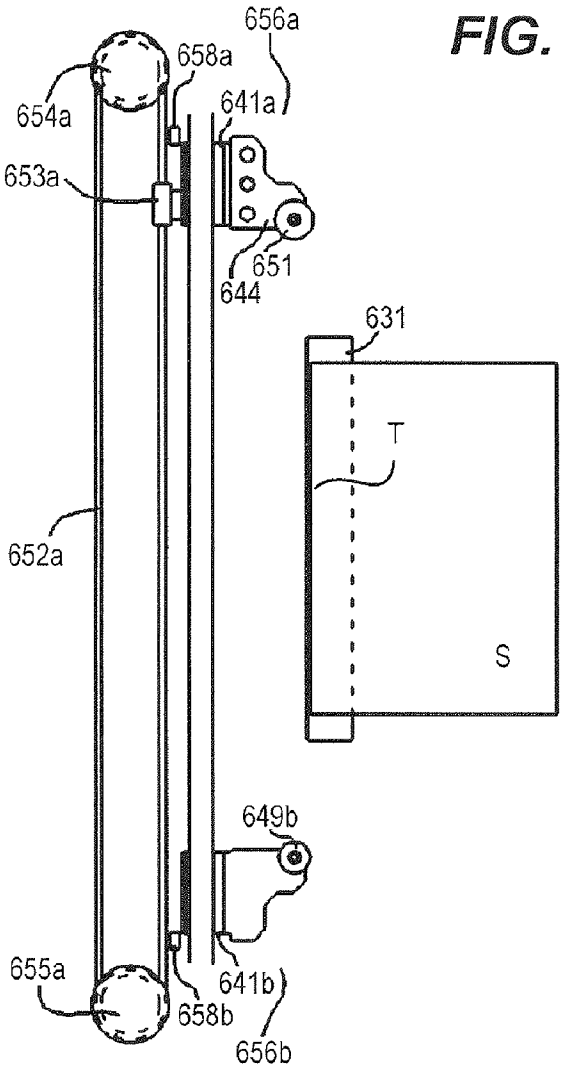
FIGS. 9A and 9B are process views illustrating an operation of the squaring unit.

As illustrated in FIG. 9*a*, the changeover unit 657 (see FIG. 6) is driven to change the stopper member 649*a* to the first pressing member 650 or the second pressing member 651 according to the thickness of the booklet S detected by the thickness detection sensor 681 (see FIG. 4). FIG. 9A illustrates that the member is changed to the second pressing member 651.

Figure 9B:
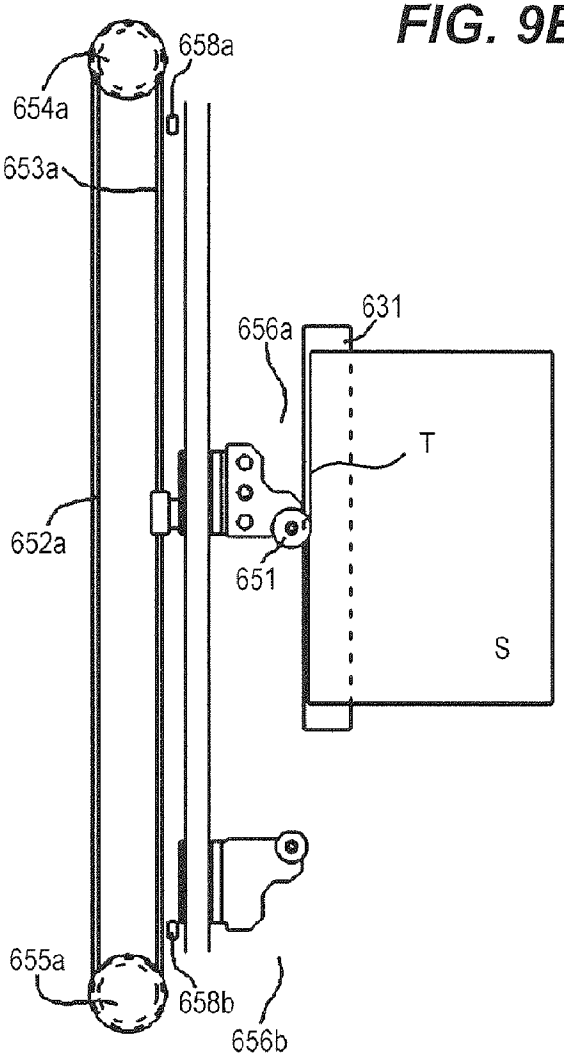
Figure 10A:
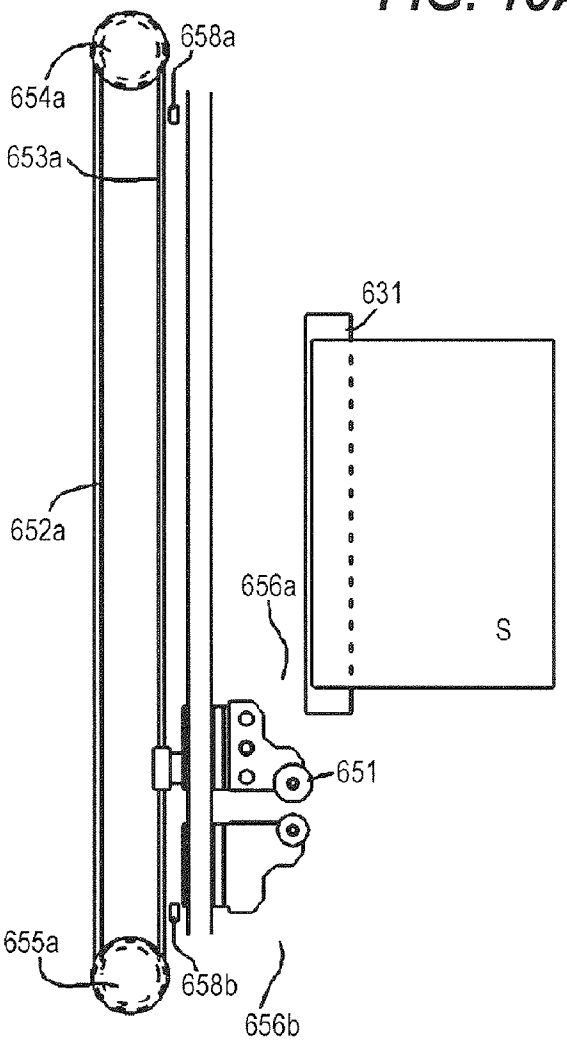
FIGS. 10A and 10B are process views illustrating an operation of the squaring unit.
Figure 10B:
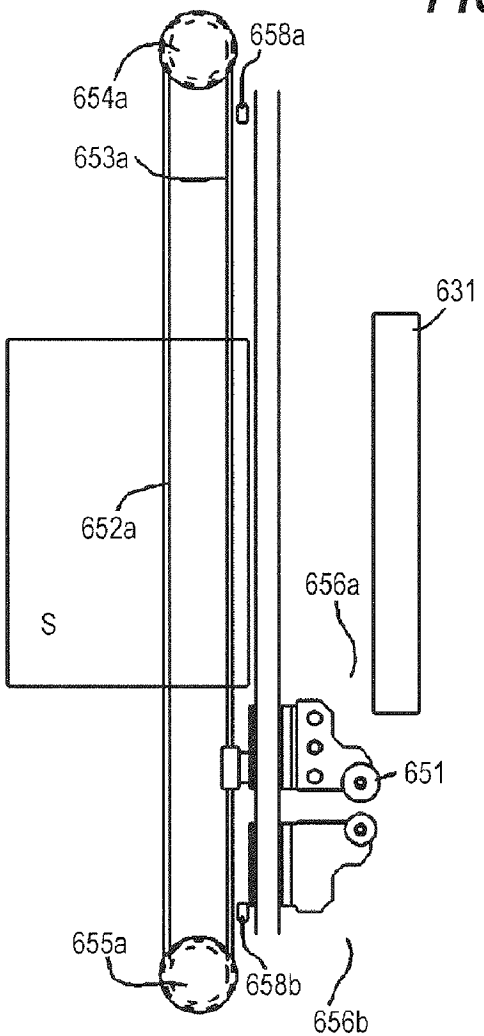

As illustrated in FIG. 9B, the moving unit 656*b* moves from one corner portion to the other corner portion of the booklet S. Thus, the second pressing member 651 is in contact with the spine T of the booklet S, whereby the spine of the booklet S is subject to the squaring process. As illustrated in FIG. 10A, when the moving unit 656*a* goes over the other corner portion of the booklet S to reach the vicinity of the moving unit 656*b*, the moving unit 656*a* stops. As illustrated in FIG. 10B, the booklet S that is subject to the squaring process is conveyed toward the downstream side in the sheet conveying direction X. FIG. 3 illustrates the booklet K having the squared spine T.

As illustrated in FIG. 4, the squaring unit 640 includes the conveying portion 660. The conveying portion 660 includes the lower conveying belt 661 and the upper conveying belt 662. The booklet S is subject to the squaring process to become the booklet K. The booklet K that is pressed and held by the holding unit 630 is released, and conveyed toward the downstream side in the sheet conveying direction X by the lower conveying belt 661 and the upper conveying belt 662. The upper conveying belt 662 can pivot about the supporting point 663 according to a thickness of the booklet K. The upper conveying belt 662 is pressed against the lower conveying belt 661 by a spring (not illustrated). The lower conveying belt 661 and the upper conveying belt 662 are coupled to the conveying portion 620 through the drive-connection, and are driven by the drive motor SM4.

As illustrated in FIG. 4, the squaring processing apparatus 600 includes a conveyer belt 671 that has stacked thereon the booklets K discharged from the conveying portion 660. The conveyer belt 671 repeats the movement in a predetermined amount based on the driving force of the drive motor SM10 every time the booklet K is discharged, thereby conveying the booklet K in the sheet conveying direction X and stacking the booklet K at the downstream side in the sheet conveying direction X. The discharge detection sensor 664 detects the discharge of the booklet K from the conveying portion 660.

Figure 11:
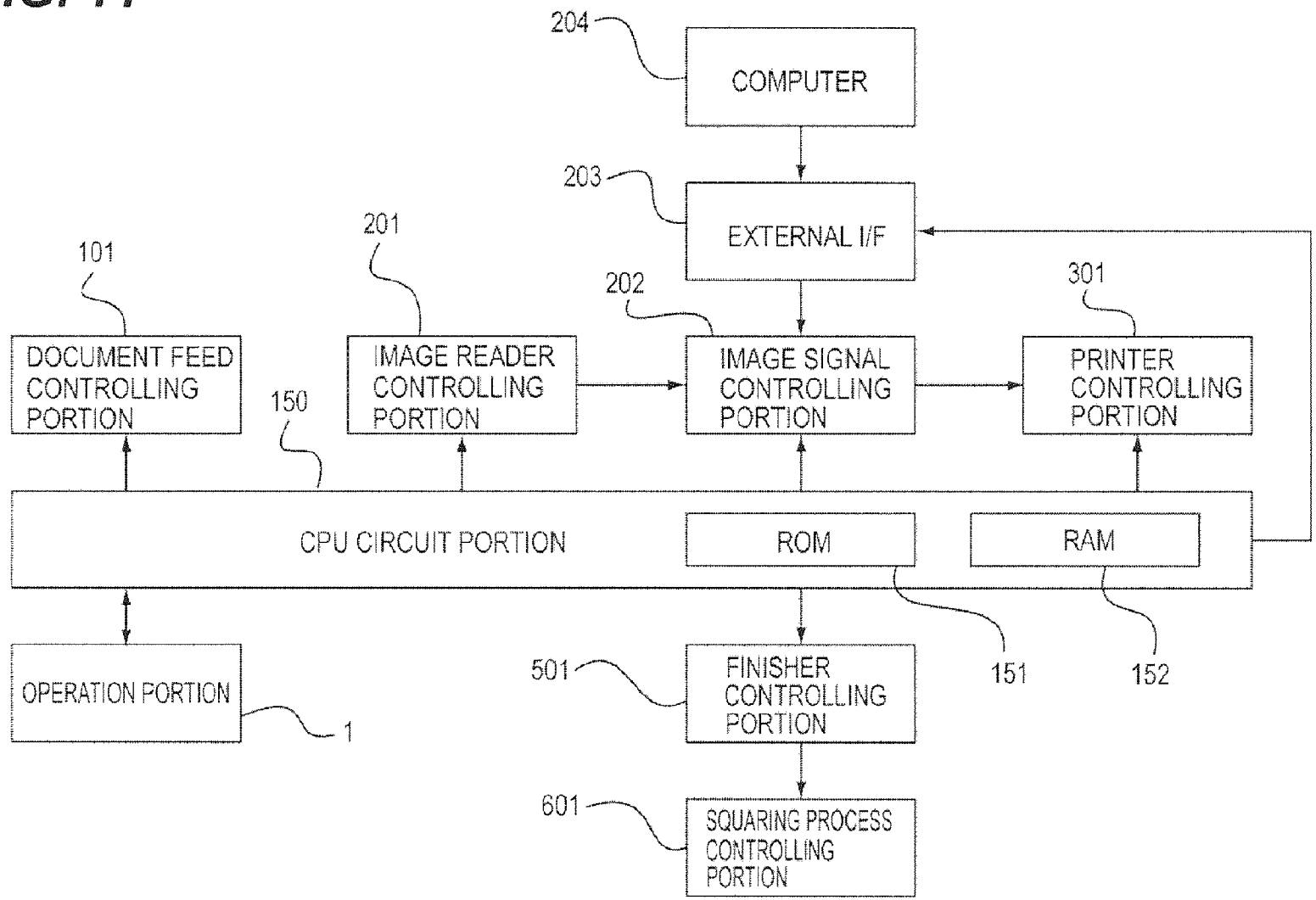
FIG. 11 is a block diagram of the copying machine.

FIG. 11 is a block diagram of the copying machine 1000. As illustrated in FIG. 11, a CPU circuit portion 150 in the copying machine 1000 has a CPU (not illustrated), wherein the CPU circuit portion 150 totally controls respective portions with a control program stored in the ROM 151 and the setting on the operation portion 1. Specifically, the CPU circuit portion 150 controls the document feed controlling portion 101, the image reader controlling portion 201, the image signal controlling portion 202, the printer controlling portion 301, the finisher controlling portion 501, and the external I/F 203. The document feed controlling portion 101 controls the document feed portion 100, the image reader controlling portion 201 controls the image reader portion 200, and the printer controlling portion 301 controls the printer portion 300. The finisher controlling portion 501 controls the finisher 500 and the saddle stitch binding portion 800, and the squaring processing portion 601 controls the squaring processing apparatus 600 based on the instruction from the finisher controlling portion 501.

The operation portion 1 has plural keys for setting various functions relating to the image formation, and a display portion for displaying the set state. The operation portion 1 outputs a key signal corresponding to the operation of each key by a user to the CPU circuit portion 150, and displays the corresponding information to the display portion based on the signal from the CPU circuit portion 150.

The RAM 152 is used as an area for temporarily retaining the control data or as a working area for computation involved with the control. The external I/F 203 is an interface between the copying machine 1000 and an external computer 204. It expands the print data from the computer 204 into a bit-mapped image, and outputs the resultant to the image signal controlling portion 202 as image data. The image reader controlling portion 201 outputs the image of the document sheet read by the image sensor (not illustrated) to the image signal controlling portion 202. The printer controlling portion 301 outputs the image data from the image signal controlling portion 202 to the exposure controlling portion (not illustrated).

Figure 12:
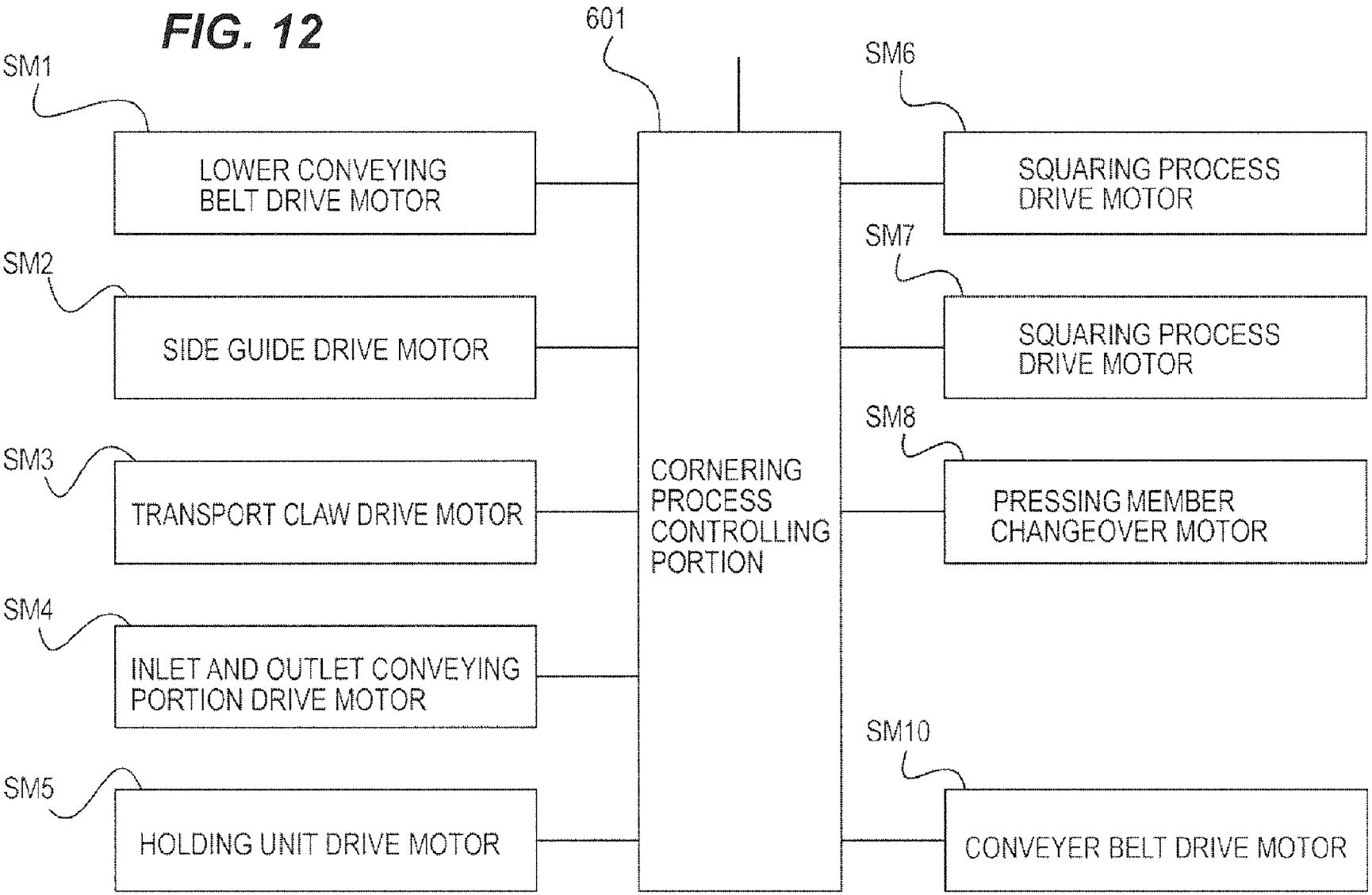
FIG. 12 is a block diagram illustrating a squaring process controlling portion.

FIG. 12 is a block diagram illustrating the squaring process controlling portion 601. As illustrated in FIG. 12, the squaring process controlling portion 601 controls the respective drive motors. Specifically, the squaring process controlling portion 601 controls the drive of the drive motor SM1 for the lower conveying belt 611 of the booklet receiving portion 610, the drive of the drive motor SM2 for the pair of side guides 612, and the drive of the drive motor SM3 for the transport claw 613. Further, the squaring process controlling portion 601 controls the drive of the drive motor SM4 for the conveying portion 620 and the conveying portion 660, and the drive of the drive motor SM5 for the holding unit 630. Further, the squaring process controlling portion 601 controls the drive of the drive motor SM6 for the squaring process, the drive of the drive motor SM7 for the squaring process, the drive of the drive motor SM8 for changing the pressing member, and the drive of the drive motor SM10 for the conveyer belt 671.

The operation of the squaring process at the squaring processing apparatus 600 will be described based on the configuration described above. The operations of the respective portions of the squaring processing apparatus 600 will be described together with the movement of the booklet S. When a saddle-stitching mode is selected by the operation portion 1, it can be selected whether the squaring process mode is set. When the squaring process mode is not selected, the saddle-stitched booklet S created at the saddle stitch binding portion 800 is discharged onto the conveyer belt 671 by the lower conveying belt 611, the transport claw 613, the conveying portion 620, and the conveying portion 660 (see FIG. 4). In this case, the pair of side guides 612, the upper holding plate 633, and moving units 656*a* and 656*b* are retracted at the position where they do not block the sheet conveying path. When the squaring process mode is selected, the squaring processing apparatus 600 operates as described below.

Figure 13:
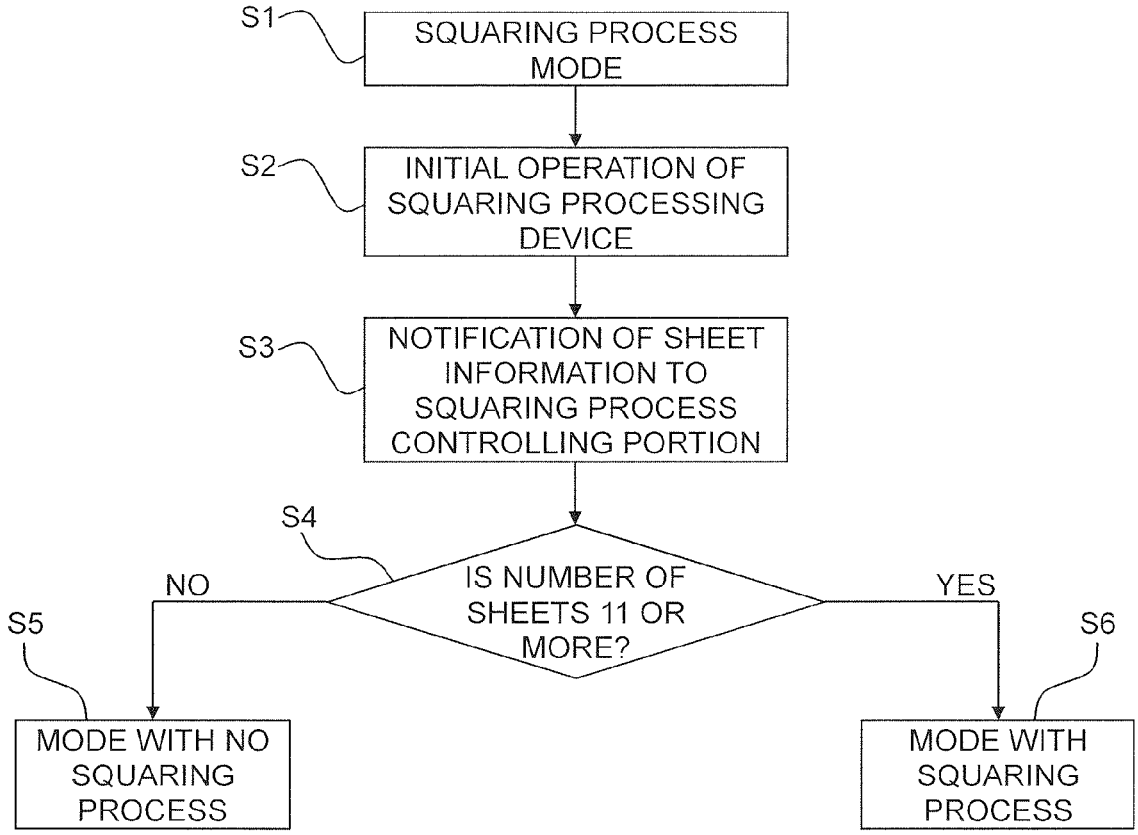
FIG. 13 is a flowchart illustrating a control process of the squaring process controlling portion, when a squaring process mode is selected.

FIG. 13 is a flowchart illustrating a control process of the squaring process controlling portion 601, when the squaring process mode is selected. As illustrated in FIG. 13, the squaring process mode is selected (step S1, "step" is merely described as "S" below, for example, S1). The squaring process controlling portion 601 causes the squaring processing apparatus 600 to perform an initial operation (S2). Upon the initial operation, the pair of side guides 612 is moved to the reference position, and the transport claw 613 is moved to the reference position. The top dead center detection sensor 639 detects that the holding base 632 is at the upper position, so that it is turned ON. Further, the moving units 656*a* and 656*b* are moved to the reference position, so that the reference position detection sensors 658*a* and 658*b* are turned ON. Further, the changeover unit 657 is moved to the reference position, so that the reference position detection sensors 659 (see FIG. 6) is turned ON.

The number of sheets of the booklet S, the size of the sheet, and the number of booklets to be formed are reported to the squaring process controlling portion 601 (S3) before the booklet S is created at the saddle stitch binding portion 800 and discharged to the receiving portion 610 of the squaring processing apparatus 600 by the pair of second fold conveying rollers 812*a* and 812*b*. The squaring process controlling portion 601 determines whether the reported number of sheets is 11 or more (S4). When the reported number of sheets of the booklet S is 10 or less (NO), the squaring process controlling portion 601 selects the mode with no squaring process (S5), while when it is 11 or more (YES), the squaring process controlling portion 601 selects the mode with the squaring process (S6).

Figure 14:
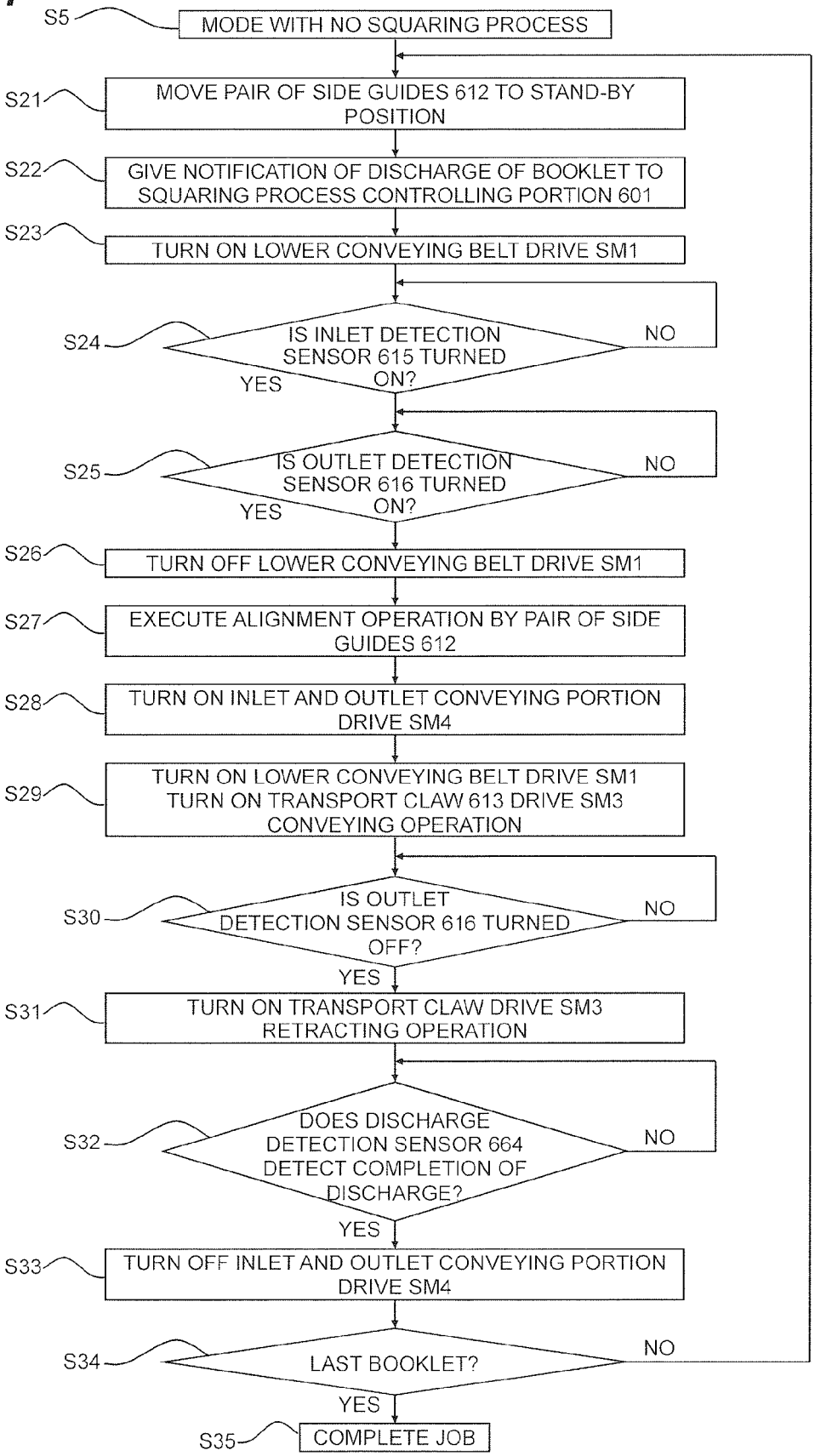
FIG. 14 is a flowchart illustrating a control process of the squaring process controlling portion, when a mode with no squaring process is selected.

FIG. 14 is a flowchart illustrating a control process of the squaring process controlling portion 601, when a mode with no squaring process is selected. As illustrated in FIG. 14, the squaring process controlling portion 601 moves the pair of side guides 612 arranged at both sides of the conveying path of the receiving portion 610 at the stand-by position according to the size of the booklet (S21). When receiving the notification of the discharge from the saddle stitch binding portion 800 (S22), the squaring process controlling portion 601 drives the drive motor SM1 to rotate the lower conveying belt 611 (S23) to convey the booklet S.

The squaring process controlling portion 601 determines whether the inlet detection sensor 615 is turned ON (S24). When the answer is YES, the squaring process controlling portion 601 determines whether the outlet detection sensor 616 is turned ON (S25). When the answer is YES, the squaring process controlling portion 601 temporarily stops the conveyance of the booklet S after receiving the result of the detection of the sheet bundle (S26). As for the processes in S24 and S25, when the answer is NO, the squaring process controlling portion 601 again performs the same control processes (S24, S25). After S26, the squaring process controlling portion 601 aligns the arrangement of the booklet S by the pair of side guides 612 based on the driving force of the drive motor SM2 (S27).

The squaring process controlling portion 601 turns ON the drive motor SM4 to drive the conveying portion 620 and the conveying portion 660 (S28). The squaring process controlling portion 601 drives the transport claw 613 and the lower conveying belt 611 arranged at the upstream side of the receiving portion 610, and drives the transport claw 613 by the drive of the drive motor SM3, thereby restarting the conveying operation of the booklet S (S29).

The squaring process controlling portion 601 determines whether the outlet detection sensor 616 is turned OFF (S30). When the answer is YES, it means that the discharge of the booklet S is detected, whereby the squaring process controlling portion 601 retracts the transport claw 613 to the upstream side in the sheet conveying direction (S31). When the answer is NO, the squaring process controlling portion 601 again performs the same control process (S30).

The squaring process controlling portion 601 discharges the booklet K conveyed by the conveying portion 620 and the conveying portion 660 to the conveyer belt 671, whereby the booklet K is stacked one by one in an imbricated state. The discharge detection sensor 664 detects the discharge of the booklet K (S32). When the answer is YES, the squaring process controlling portion 601 turns OFF the drive motor SM4 to stop the drive of the conveying portion 620 and the conveying portion 660 (S33). When the answer is NO, the squaring process controlling portion 601 again performs the same control process (S32).

The squaring process controlling portion 601 determines whether the discharged booklet K is the last booklet K (S34) after the drive of the conveying portion 620 and the conveying portion 660 is stopped (S33). When the answer is YES, the squaring process controlling portion 601 ends the job (S35), while it again performs the control process from S21, when the answer is NO.

Figure 15:
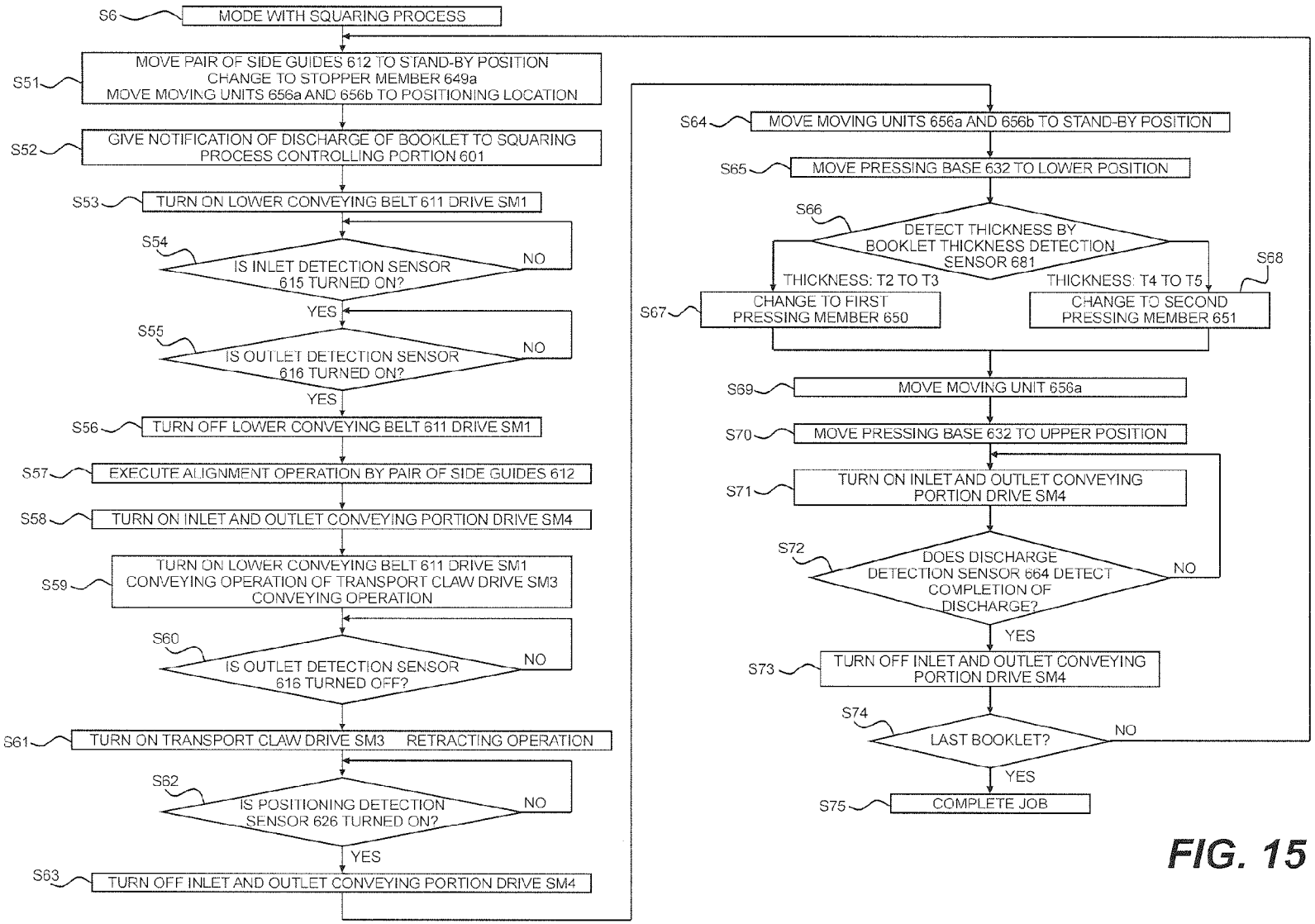
FIG. 15 is a flowchart illustrating a control process of the squaring process controlling portion, when a mode with squaring process is selected.

FIG. 15 is a flowchart illustrating a control process of the squaring process controlling portion 601, when a mode with squaring process is selected. As illustrated in FIG. 15, the squaring process controlling portion 601 moves the pair of side guides 612 arranged at both sides of the conveying path of the receiving portion 610 at the stand-by position according to the size of the booklet (S51). The squaring process controlling portion 601 changes the member to the stopper member 649*a* by the changeover unit 657, whereby the moving units 656*a* and 656*b* move to the positioning location (S51). The positioning location is changed according to the size of the booklet S. The positioning location is set to the position where the stopper members 649*a* and 649*b* do not rotate when the spine T of the booklet S hits the stopper members 649*a* and 649*b* and the parallel state of the spine T of the booklet S is maintained with respect to the moving direction of the moving units 656*a* and 656*b*.

When receiving the notification of the discharge of the booklet S from the saddle stitch binding portion 800 (S52), the squaring process controlling portion 601 rotates the lower conveying belt 611 based on the drive of the drive motor SM1 (S53). The squaring process controlling portion 601 conveys the booklet S, and determines whether the inlet detection sensor 615 is turned ON (S54). When the answer is YES, the squaring process controlling portion 601 conveys the booklet S and determines whether the outlet detection sensor 616 is turned ON (S55). When the answer is NO, the squaring process controlling portion 601 again performs the same control process (S54).

When the answer is YES as a result of the determination as to whether the outlet detection sensor 616 is turned ON (S55), the squaring process controlling portion 601 stops the drive of the drive motor SM1 to temporarily stop the rotation of the lower conveying belt 611 of the receiving portion 610 (S56). When the answer is NO, the squaring process controlling portion 601 again performs the same control process (S55). After the lower conveying belt 611 is stopped, the squaring process controlling portion 601 aligns the booklet S by the pair of side guides 612 based on the driving force of the drive motor SM2 (S57).

The squaring process controlling portion 601 turns ON the drive motor SM4 to drive the conveying portion 620 and the conveying portion 660 (S58). The squaring process controlling portion 601 turns ON the drive motor SM1 to rotate the lower conveying belt 611 of the receiving portion 610 (S59). The squaring process controlling portion 601 turns ON the drive motor SM3 to drive the transport claw 613 and the lower conveying belt 611 arranged at the upstream side of the receiving portion 610, thereby restarting the conveying operation of the booklet S (S59).

The squaring process controlling portion 601 determines whether the outlet detection sensor 616 is turned OFF (S60). When the answer is YES, it means that the discharge of the booklet S is detected, whereby the squaring process controlling portion 601 retracts the transport claw 613 to the upstream side in the sheet conveying direction X (S61). When the answer is NO, the squaring process controlling portion 601 again performs the same control process (S60).

The squaring process controlling portion 601 determines whether the positioning detection sensor 626 is turned ON (S62) as a result of the retract of the transport claw 613 toward the upstream side in the sheet conveying direction X (S61). When the answer is YES, which means that the positioning detection sensor 626 detects the conveyed booklet S by the conveying portion 620, the squaring process controlling portion 601 turns OFF the drive motor SM4 to stop the drive of the conveying portion 620 and the conveying portion 660 (S63). The flow afterward will be described with reference to FIGS. 16 to 18.

Figure 16:
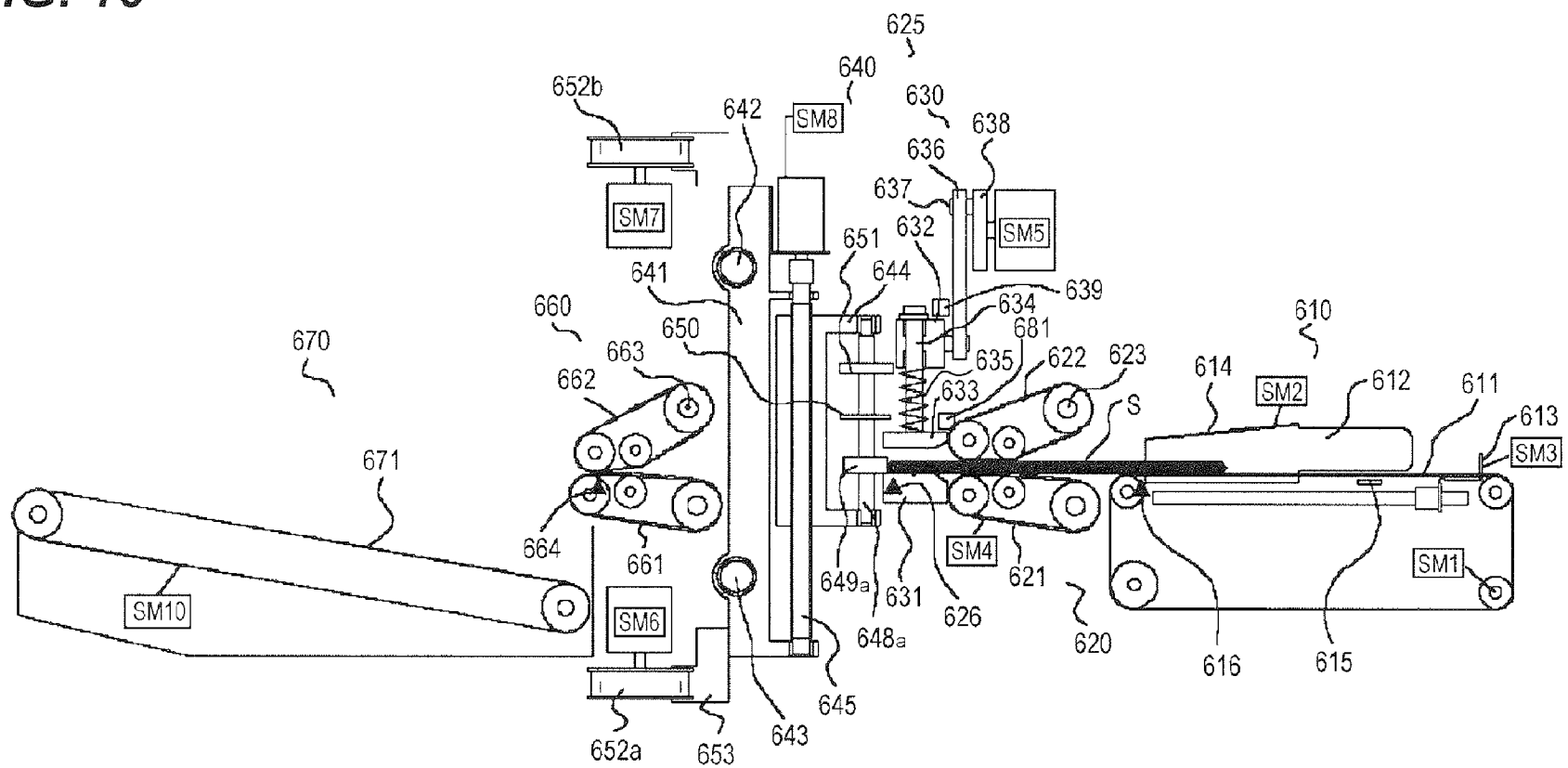
FIG. 16 is a sectional view illustrating the state in which the stopper member receives the spine of the booklet.

FIG. 16 is a sectional view illustrating the configuration of the squaring processing apparatus 600 that illustrates the state in which the stopper members 649*a* and 649*b* receive the spine T of the booklet S. FIG. 17 is a sectional view illustrating the configuration of the squaring processing apparatus 600 that illustrates the state in which the first pressing member 650 presses the spine T of the booklet S. FIG. 18 is a sectional view illustrating the configuration of the squaring processing apparatus 600 that illustrates the state in which the second pressing member 651 presses the spine T of the booklet S. As illustrated in FIG. 16, the booklet S is positioned at the location where the spine T of the booklet S hits the stopper members 649*a* and 649*b*, and the spine T of the booklet S does not project from the downstream lower end between the lower holding plate 631 and the upper holding plate 633 in the sheet conveying direction X. The squaring process controlling portion 601 moves the moving units 656*a* and 656*b* to the position that is outside the portion between the lower holding plate 631 and the upper holding plate 633 (the position at the side of the lower holding plate 631 and the upper holding plate 633), i.e., to the stand-by position (S64). The squaring process controlling portion 601 moves the holding base 632 to the lower position by the drive of the drive motor SM5 (S65) so as to press and hold the spine T of the booklet S by the lower holding plate 631 and the upper holding plate 633. The squaring process controlling portion 601 detects the position of the upper holding plate 633, which presses and holds the booklet S, by the thickness detection sensor 681 (S66), whereby the thickness of the booklet S is measured.

Figure 17A:
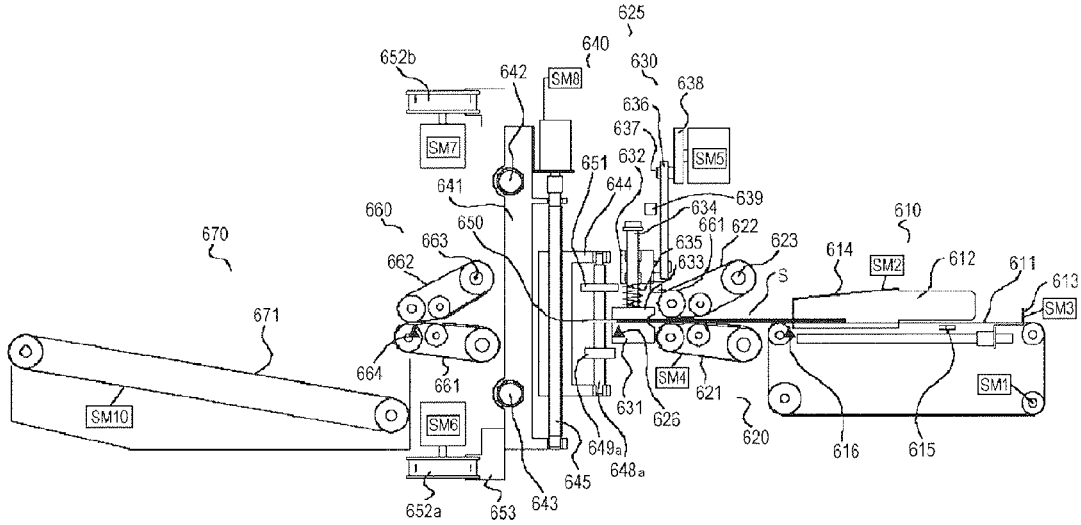
FIGS. 17A and 17B are sectional views illustrating the state in which the first pressing member presses the spine of the booklet.
Figure 18A:
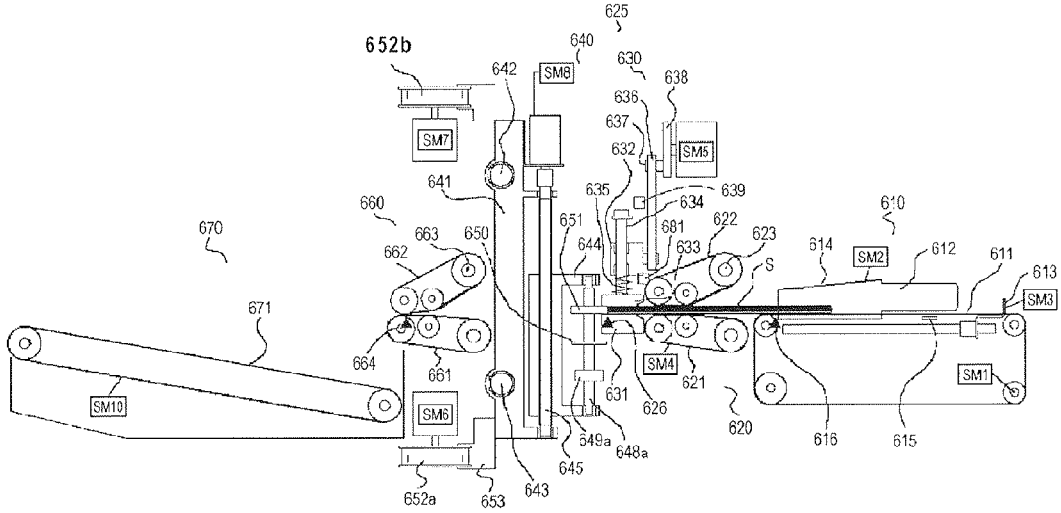
FIGS. 18A and 18B are sectional views illustrating the state in which the second pressing member presses the spine of the booklet.

When the thickness of the booklet S is within the above-mentioned range of T2 to T3, the squaring process controlling portion 601 changes the pressing member to the first pressing member 650 (S67), while when the thickness of the booklet S is within the range of T4 to T5, it changes the pressing member to the second pressing member 651 (S68). The squaring process controlling portion 601 moves the moving unit 656*a* (S69) to control the drive of the first pressing member 650 or the second pressing member 651 so as to perform the squaring process to the spine T of the booklet S. This process is illustrated in FIGS. 17A and 18A. FIG. 17A is a view illustrating that the squaring process is performed with the use of the first pressing member 650, while FIG. 18A is a view illustrating that the squaring process is performed with the use of the second pressing member 651.

As described above, the spine T of the booklet S is enclosed by the lower holding plate 631 and the upper holding plate 633, and further, enclosed by the first pressing member 650 or the second pressing member 651. Therefore, extra pressing force is not applied to the spine T, resulting in that a smooth surface having a width substantially equal to the thickness of the booklet S is formed. Accordingly, the spine of the booklet S is not necessarily deformed. The positioned location is made equal by the stopper members 649*a* and 649*b*, regardless of the thickness of the booklet S, whereby the pressing amount of the thick booklet S is set, by the thickness and the diameter of the pressing member, to be always greater than the pressing amount of the thin booklet S. Therefore, the excessive deformation of the thin booklet S and the insufficient deformation of the thick booklet S can be prevented, whereby the good-looking booklet S can stably be formed.

Figure 17B:
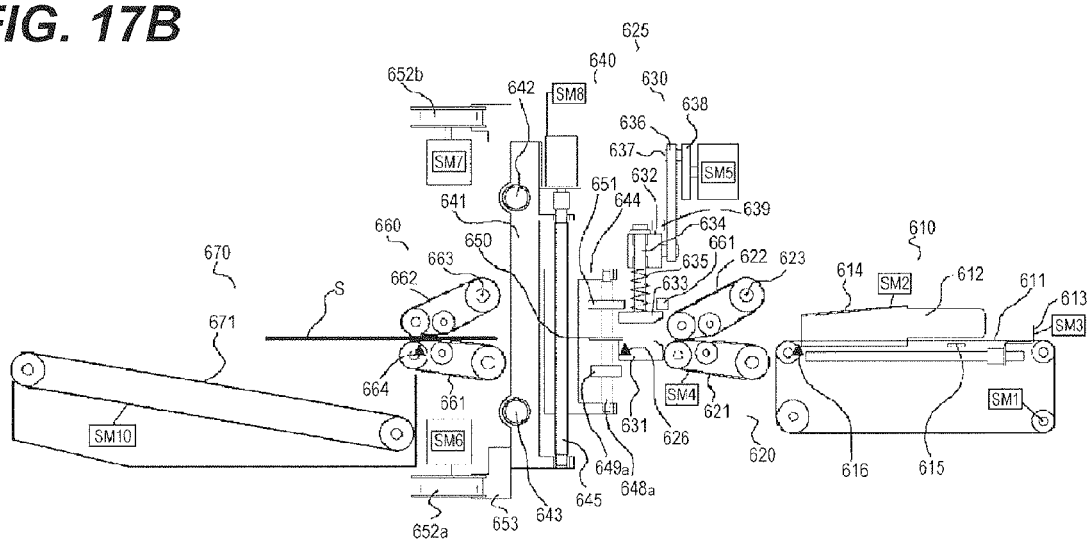
Figure 18B:
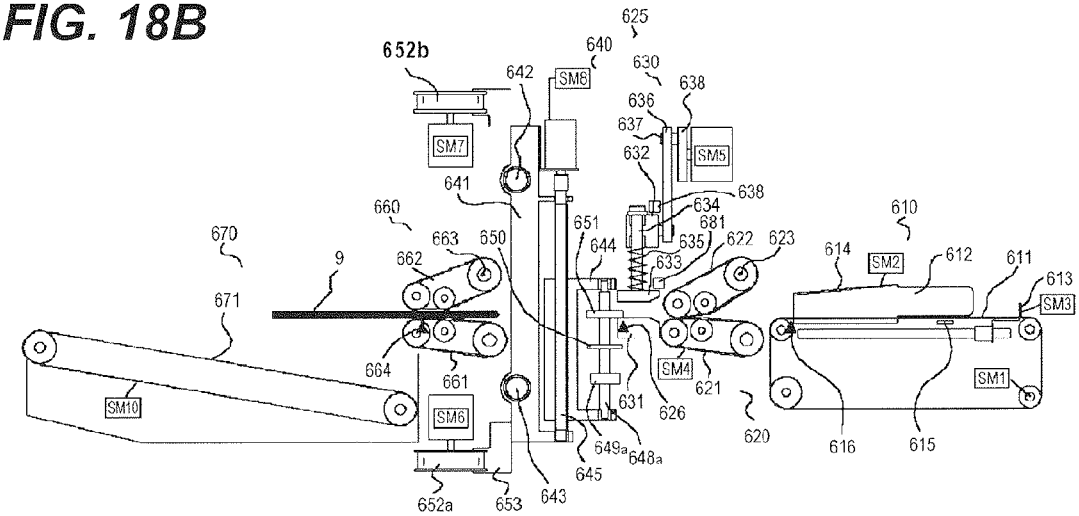
Figure 19E:
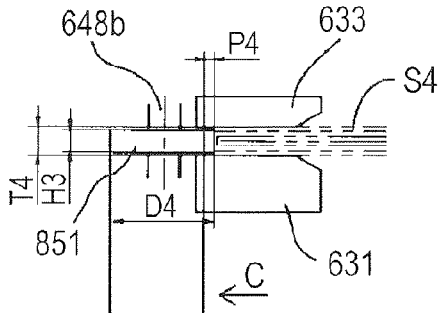
FIGS. 19A to 19F are sectional views illustrating an abutment state in which a spine abuts against a stopper member, a first pressing member, and a second pressing member according to a second embodiment of the present invention.
Figure 19F:
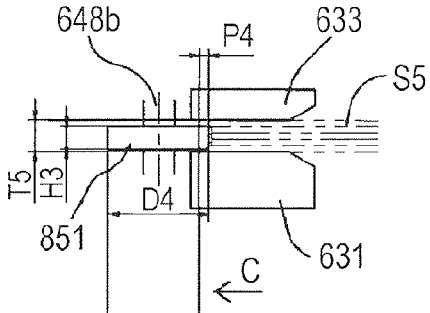
Figure 19C:
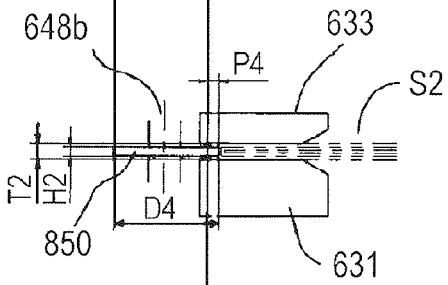
Figure 19D:
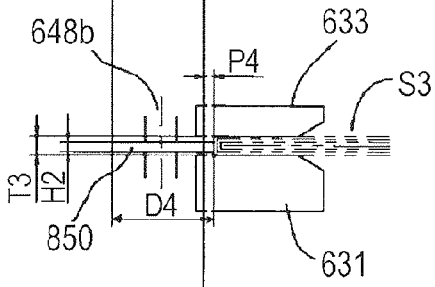
Figure 19A:
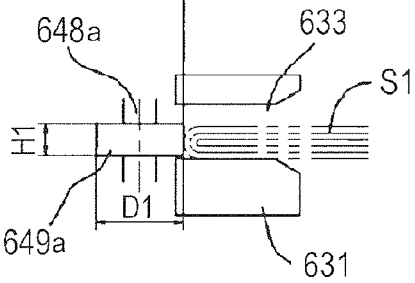
Figure 19B:
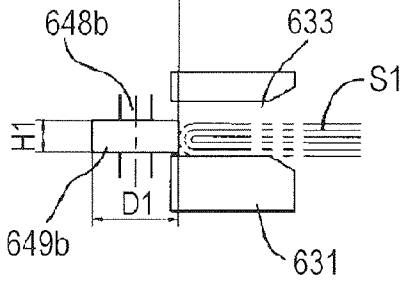

After the movement of the moving unit 656*a* is completed, the squaring process controlling portion 601 moves the holding base 632 to the upper position (S70) so as to separate the lower holding plate 631 and the upper holding plate 633. The squaring process controlling portion 601 drives the conveying portion 620 and the conveying portion 660 based on the drive of the drive motor SM4 (S71), so that the booklet K conveyed by the conveying portion 660 is discharged to the conveyer belt 671 that is the conveyer tray. This process is illustrated in FIGS. 17B and 18B. The squaring process controlling portion 601 determines whether the outlet detection sensor 664 detects that the discharge of the booklet K is completed (S72). When the answer is YES, the squaring process controlling portion 601 turns OFF the drive motor SM4 to stop the drive of the conveying portion 620 and the conveying portion 660 (S73). The booklet K discharged onto the conveyer belt 671 is stacked one by one in an imbricated state. The squaring process controlling portion 601 determines whether the discharged booklet K is the last booklet K (S74). When the answer is YES, the squaring process controlling portion 601 ends the job (S75), while it again performs the control process from S51, when the answer is NO.

In the present embodiment, the booklet S is positioned at the same location, regardless of the thickness of the booklet S, and the first pressing member 650 having a small thickness and small diameter is used for the thin booklet S, while the second pressing member 651 having a great thickness and great diameter is used for the thick booklet S. Thus, the pressing amount is changed according to the thickness of the booklet S, whereby the pressing amount for the thin booklet S can be set to be small, and the pressing amount for the thick booklet S can be set to be great. Consequently, an excessive deformation to the spine T of the thin booklet S and insufficient deformation to the spine T of the thick booklet S are prevented, whereby the shape of the booklet S that is subject to the squaring process can be stabilized. Since the positioned location of the booklet S is fixed, there is no need to drive the stopper members 649*a* and 649*b* in the sheet conveying direction X. Therefore, the copying machine 1000 and the squaring processing apparatus 600 can be simplified, and the control can be simplified.

As described above, the present embodiment prevents the phenomenon in which the spine T spreads. Specifically, one of the first pressing member 650 and the second pressing member 651 selectively enters a gap between the lower holding surface 631*a* and the upper holding surface 633*a* so as to press the spine T of the booklet K. Therefore, the phenomenon can be prevented in which the pressed spine T of the booklet K spreads outward to cause that the width of the squared plane unfavorably becomes greater than the thickness of the booklet K.

Second Embodiment

As described above, in the first embodiment, the pressing members, each having a different thickness and different diameter, are changed according to the thickness of the booklet S in order to perform the squaring process. In a second embodiment, a first pressing member 850 and a second pressing member 851, each having a different thickness but same diameter, are used according to a thickness of a booklet S. In the second embodiment, the portions same as those in the first embodiment are identified by the same numerals and the description will not be repeated. FIGS. 19A to 19F are enlarged views of essential parts illustrating the relationship between the stopper member 649, the first pressing member 850, and the second pressing member 851, and the spine T.

As illustrated in FIG. 19, in the present embodiment, the holding unit 630 having the lower holding plate 631 and the upper holding plate 633 can slide in the direction indicated by an arrow C in the figure by a driving source (not illustrated) in order that the distance to the first pressing member 850 or the second pressing member 851 can be changed. The first pressing member 850 has a thickness H2 and a diameter D4, and the second pressing member 851 has a thickness H3 and a diameter D4, which means they are different from each other in thickness, but same as the diameter. In the present embodiment, when the thickness of the booklet S is within T2 to T3, the squaring process is performed by sliding the holding unit 630 with the use of the first pressing member 850 with the deformation amount (pressing amount) P4, while when the thickness of the booklet S is within T4 to T5, the squaring process is performed by sliding the holding unit 630 with the use of the second pressing member 851 with the deformation amount (pressing amount) P5.

In the above description, the thickness of the booklet S is classified into two cases, and two types of pressing members, each having a different thickness, are used. However, the invention is not limited thereto. For example, the thickness of the booklet may be classified into three, four, or more, and the types of the pressing members to be used may be increased, as in the first embodiment. On the contrary, one type of pressing member may be used, and the deformation amount (pressing amount) may be changed according to the thickness of the booklet.

Although the distance between the pressing member and the holding unit 630 is changed by the sliding movement of the holding unit 630, it may be changed by the slide movement of the squaring unit 640 with respect to the holding unit 630. Specifically, at least one of the squaring unit 640 and the holding unit 630 may slide.

In the above-mentioned first and second embodiments, a booklet S formed by folding a single sheet in two to a booklet formed by folding 25 sheets in two are illustrated as the booklet S formed by the saddle stitch binding portion 800. However, the number of sheets may be changed according to the capability of the saddle stitch binding portion 800. In the above description, the booklet S that is subject to the squaring process has 11 or more folded sheets in two. However, the number of sheets of the booklet may be changed according to the basis weight or thickness of the media (sheet), and this does not limit the present invention. Further, two cases are set according to the thickness of the booklet that is to be subject to the squaring process. In the above description, two types of pressing members, each having a different thickness and different diameter, are used. However, the invention is not limited thereto. More cases may be set, and the types of the pressing members to be used may be increased. This does not limit the present invention. In the above-mentioned embodiment, the cases are classified by detecting the thickness of the booklet S by the sensor. However, the cases are classified according to the condition that can determine the thickness of the booklet S, such as the basis weight of the media (sheet), thickness, and number of sheets.

According to the present invention, when a spine of a booklet is pressed by a pressing member to perform a deforming (squaring) process, a pressing amount is changed according to the thickness of the booklet in such a manner that the pressing amount for a thin booklet is small and the pressing amount for a thick booklet is great. Accordingly, an excessive deformation to the thin booklet and insufficient deformation to the thick booklet are prevented, whereby the shape of the booklet that is subject to the deforming (squaring) process can be stabilized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-232999, filed Oct. 7, 2009, which is hereby incorporated by reference herein in its entirety.

What is claimed is:

1. A sheet processing apparatus comprising:

a holding portion that holds a booklet, which includes folded sheets, by a pair of holding members opposite to each other;

a pressing portion configured to press a spine of the booklet held by the holding portion, having a first pressing member and a second pressing member having a thickness, in a thickness direction of the booklet, greater than that of the first pressing member; and a moving portion that moves the pressing member along the spine, wherein one of the first pressing member and the second pressing member selectively enters a gap between the pair of holding members and presses the spine of the booklet held by the holding portion while the one pressing member is moving along the spine so as to deform the spine, and wherein in a case of processing a booklet having a thickness greater than a predetermined thickness, the second pressing member is selected to press the spine, and a pressing amount in a pressing direction of pressing the spine by the second pressing member is greater than that by the first pressing member.

2. The sheet processing apparatus according to claim 1, further comprising a positioning portion that positions the spine of the conveyed booklet to a predetermined location in the pressing direction, wherein the one pressing member presses the spine of the booklet positioned to the predetermined location by the positioning portion.

3. The sheet processing apparatus according to claim 2, wherein the first and second pressing members are rotating members coaxially provided, and wherein the diameter of the second pressing member is greater than the diameter of the first pressing member.

4. The sheet processing apparatus according to claim 3, wherein the positioning portion has a receiving member that receives the spine of the conveyed booklet, and the receiving member is coaxially provided with the first and second pressing members.

5. The sheet processing apparatus according to claim 4, wherein the receiving member can move in the thickness direction, and in a sheet width direction parallel to the spine of the booklet.

6. The sheet processing apparatus according to claim 1, wherein at least one of the first and second pressing members and the holding portion moves in the pressing direction of pressing the spine by the first and second pressing members to change the pressing amount in the pressing direction.

7. An image forming system comprising:

an image forming portion that forms an image;

a folding portion that performs a folding process to the sheet having an image formed thereon;

a holding portion that holds a booklet, which includes sheets folded by the folding portion, by a pair of holding members opposite to each other;

a pressing portion configured to press a spine of the booklet held by the holding portion, having a first pressing member and a second pressing member having a thickness, in a thickness direction of the booklet, greater than that of the first pressing member; and a moving portion that moves the pressing member along the spine, wherein one of the first pressing member and the second pressing member selectively enters a gap between the pair of holding members and presses the spine of the booklet held by the holding portion while the one pressing member is moving along the spine so as to deform the spine, and wherein in a case of processing a booklet having a thickness greater than a predetermined thickness, the second pressing member is selected to press the spine, and a pressing amount in a pressing direction of pressing the spine by the second pressing member is greater than that by the first pressing member.

8. The image forming system according to claim 7, further comprising a positioning portion that positions the spine of the conveyed booklet to a predetermined location in the pressing direction, wherein the one pressing member presses the spine of the booklet positioned to the predetermined location by the positioning portion.

9. The image forming system according to claim 8, wherein the first and second pressing members are rotating members coaxially provided, wherein the diameter of the second pressing member is greater than the diameter of the first pressing member.

10. The image forming system according to claim 9, wherein the positioning portion has a receiving member that receives the spine of the conveyed booklet, and the receiving member is coaxially provided with the first and second pressing members.

11. The image forming system according to claim 10, wherein the receiving member can move in the thickness direction, and in a sheet width direction parallel to the spine of the booklet.

12. The image forming system according to claim 7, wherein at least one of the first and second pressing members and the holding portion moves in the pressing direction of pressing the spine by the first and second pressing members to change the pressing amount in the pressing direction.

* * * * *